US010366579B2

(12) United States Patent
Steinberg

(10) Patent No.: US 10,366,579 B2
(45) Date of Patent: Jul. 30, 2019

(54) PADDLE WHEEL POKER

(71) Applicant: Norman Steinberg, Doylestown, PA (US)

(72) Inventor: Norman Steinberg, Doylestown, PA (US)

( * ) Notice: Subject to any disclaimer, the term of this patent is extended or adjusted under 35 U.S.C. 154(b) by 75 days.

(21) Appl. No.: 15/704,756

(22) Filed: Sep. 14, 2017

(65) Prior Publication Data

US 2018/0082539 A1 Mar. 22, 2018

Related U.S. Application Data

(60) Provisional application No. 62/396,376, filed on Sep. 19, 2016.

(51) Int. Cl.
*G07F 17/32* (2006.01)

(52) U.S. Cl.
CPC ..... *G07F 17/3293* (2013.01); *G07F 17/323* (2013.01); *G07F 17/3258* (2013.01); *G07F 17/3276* (2013.01); *G07F 17/3288* (2013.01)

(58) Field of Classification Search
None
See application file for complete search history.

(56) References Cited

U.S. PATENT DOCUMENTS 9,564,016 B2 * 2/2017 LaDuca ..... A63F 3/00157
2006/0119044 A1 * 6/2006 Kekempanos ..... A63F 3/00157 273/292
2006/0270477 A1 * 11/2006 Snow ..... A63F 1/00 463/11
2007/0075494 A1 * 4/2007 Abbott ..... A63F 3/00157 273/274
2008/0136104 A1 * 6/2008 Matanky ..... A63F 1/00 273/292
2011/0095481 A1 * 4/2011 Patelidas ..... A63F 3/00157 273/292
2012/0149451 A1 * 6/2012 Nicely ..... G07F 17/32 463/13

* cited by examiner

*Primary Examiner* — Ronald Laneau
(74) *Attorney, Agent, or Firm* — Ingenium Patents LLC; Peter R. Kramer

(57) ABSTRACT

A community poker-type game that requires recognizing a favorable community card group and physically select that favorable community card group in an allotted time when that community card group becomes available. The game provides players with the choice of as many as seven different community card groups to form a best five-card poker hand. Game play can begin by two cards being dealt to at least two players. A first group of five community cards are dealt face-down in a crisscross pattern followed by a process whereas the players select a five-card community group during the timed-deal of four community cards face-up to the outermost points of the five face-down community cards. A best five-card poker hand is determined for each player which can include from zero to two of the cards dealt to each player with at least three cards from the players selected five-card community group.

19 Claims, 17 Drawing Sheets

PADDLE WHEEL POKER

REFERENCE TO RELATED APPLICATIONS

This application claims one or more inventions which were disclosed in Provisional Application No. 62/396,376, filed Sep. 19, 2016, entitled "MODIFIED COMMUNITY POKER-TYPE GAME". The benefit under 35 U.S.C. § 119(e) of the United States provisional application is hereby claimed, and the aforementioned application is hereby incorporated herein by reference.

CROSS-REFERENCE TO RELATED APPLICATIONS

N/A

STATEMENT REGARDING FEDERALLY SPONSORED RESEARCH OR DEVELOPMENT

N/A

REFERENCE TO SEQUENCE LISTING, A TABLE, OR A COMPUTER PROGRAM LISTING COMPACT DISC APPENDIX

N/A

FIELD OF ART

This application relates generally to card games and methods thereof, and more particularly, relates to the modification of a poker-type card game utilizing community cards in which players attempt to achieve the highest ranking five-card poker hand by combining two cards dealt to the player along with a five-card community group available to the player.

BACKGROUND

Poker is a favorite card game which is played by many people. Typically, the game is played with a standard deck of 52 playing cards. The objective of most games of poker is to form a five card poker hand better than the five-card poker hand of one or more opponents, or to bet in such a way as to make the opponents believe their hand is inferior. The individual cards are ranked in the following order from highest to lowest: Ace, King, Queen, Jack, 10, 9, 8, 7, 6, 5, 4, 3, 2. The suits are clubs, diamonds, hearts and spades.

The hands are ranked in the following order from highest to lowest:

(1) Five of a Kind—Five cards of equal rank.

(2) Royal Flush—Ace, King, Queen, Jack, 10—all of the same suit.

(3) Straight Flush—Five cards, all of the same suit, in sequence.

(4) Four of A Kind—Four cards of equal rank.

(5) Full House—Three cards of equal rank and two cards of equal rank.

(6) Flush—Any five cards of the same suit.

(7) Straight—Five cards of mixed suits, in sequence.

(8) Three of a Kind—Three cards of equal rank.

(9) Two Pair—Two cards of equal rank and a different two cards of equal rank.

(10) One Pair—Two cards of equal rank.

(11) High Card—The card that has the highest rank.

For example, hand (5), a Full House, is better than hands (6) through (11). However, hands (1) through (4), are each better than hand (5). The best hand among the players is declared. The player who has the best hand is the winner. If two or more players have the same best hand, the best hand with the highest ranking of individual card(s) is determined. The player who has this hand is then declared the winner.

Poker can be played using a set number of designated community cards which players share to combine along with the cards dealt to the players to make their best five-card poker hand. One popular community card version of poker is "Texas Hold'em". Typically, play begins with one player designated as the dealer, and the two players to the immediate left of the dealer placing forced wagers (the "blinds"). Each player is then dealt two "hole" cards. A first round of betting occurs, wherein each player decides whether to fold, call, or raise the bet of the prior player. Following the conclusion of the first betting round, three community cards are dealt face up, and these three cards are referred to as the "flop."

A second round of betting takes place after the flop is dealt. Next, a single community card known as the "turn" is dealt face-up. Another round of betting follows the turn, and finally the fifth and final community card is dealt face up, known as the "river" card. When at least two players remain in the hand a final round of betting occurs after the river card is dealt. The "showdown" is next, where players show their hands. The player having the highest ranking five-card poker hand formed from the player's two hole cards and the five community cards wins the "pot," which includes all bets placed during the hand, minus a percentage for the house or casino providing the game. This percentage is referred to as the "rake."

Games like Texas Hold'em have several flaws. Players will seldom participate in a hand until two favorable hole cards are dealt to them. Only the blinds are required to bet in a hand while the other players can examine and discard their inferior hole cards without penalty. This results in a lack of participation by all players. Because of this, games like Texas Hold'em have become a wagering game wherein the exchanging and resolving of a financial obligation (a bet) between players is based solely on the probabilities during the distribution of the players' hole cards, limiting the mental skill component of the game to a choice of whether to play the hand or discard the cards, before one single community card is dealt.

Community card poker games such as Omaha Poker and Pineapple Poker try to induce greater player participation by dealing the players extra hole cards, but this makes poker, which is commonly referred to as an "imperfect game" more imperfect, due to the increase in the number of unknown cards. This type of modification, of course, also decreases players' "outs".

Another flaw of Texas Hold'em is "unsubstantiated" bluffing due to the limited number of cards exposed during play, which slows down the game and produces boring play.

Community poker games such as Texas Hold'em are limited to a single community group to all players, which the players have no choice thereof, which does not offer a game which has a high frequency of value poker hands being dealt, and narrows the players to any flexibility thereof. Thus the players have no flexibility to construct a more competitive poker hand, leaving no option but to standby for favorable hole cards to be dealt to them.

Community poker games have become popular online, and as a result, recent problems have surfaced. Because games akin to Texas Hold'em lack community card group diversity, players have found ways to gain an edge using computer software systems. Because there is only one five-card community group shared by all players, it is relatively easy for players to apply software systems to assess their hole cards alone, or their hole cards coupled with the community cards dealt, to estimate their odds of defeating their opponents. Robotic play using "cheating" computer software systems has discouraged players from playing online.

In view of the above mentioned problems and limitations associated with playing community card poker-type games, it was recognized by the present inventor, who was once an Internet poker software entrepreneur at the turn of the Millennium, that there is an unfulfilled need for an improved method for playing a modified version of community card poker which induces greater player participation. The improved method should also utilize components of both mental and physical skill, and at the same time offer simplicity, practicality, a game that is fun to play, a game that can be easily learned, and a game that can be played on a level playing field online.

Accordingly, it becomes clear that there is a great need for a method for playing a modified community card poker-type game which overcomes the disadvantages associated with current community card poker games. From the embodiments of the application to follow, many advantages of the embodiment will become clear over other related community card poker games such as Texas Hold'em, or variations thereof.

SUMMARY

The summary provides the abstract in a shortened form that is described below in the DETAILED DESCRIPTION of the preferred embodiment. This summary is not intended to name all the key features of the claimed method, nor is it intended to be used in evaluating and determining the scope of the claimed modified method.

In view of the specified issues in the BACKGROUND discussion and limitations associated with playing standard community poker-type card games, it has been identified by the present inventor that there is a need for an improved method for playing a version of community poker which cause greater player participation, and is played using a standard deck of 52 playing cards, with the players dealt the customary two hole cards. The present inventor believes that this method can be maximized by a community card group comprising nine cards, patterned in such a way as to afford the players a choice of seven different five-card community group options, which offers players a high frequency of value poker hands. Further, the method bellows for player skill because its main objective is to skillfully identify a favorable five-card community group as it becomes available during the deal of the final four community cards, and manually select that favorable community card group on a screen, within a timed-period, before it revolves to the next set of eligible community groups. The method includes prompts to make the players aware of five-card community groups as they become available during the deal of the final four community cards.

Further, the presence of multiple community groups in the game, and the time allotted players to select a community group, significantly defuses the use of extemporaneous computer software "cheating" programs.

The method includes modifying a community card poker game, which generally offers a single five-card community group to the player. The modification allow players seven distinct five-card community groups, sharing the same final river card, which is achieved by only increasing the total number of community cards dealt by four. In the present invention less emphasis is put on poker chips moving around a table, and instead players' attention is focused on the progression of the community card area, which is a newly-added phase of the game. Further, the method gives the player flexibility to select a five-card community group after the player has been given the opportunity to view at least two cards in six of the seven five-card community groups. The game can be played in two versions: players can select their five-card community group during the deal of the final four community cards; or after all the community cards have been dealt.

The method of playing the modified community card poker game requires an element of skill without creating complexity, while preserving the end principle of the game. The method builds larger pots by retaining players in the hand longer through the method's offering of multiple high-value five-card community group options and a mandatory starting bid. Bluffing is minimized due to the plurality of five-card community card groups available to the players, and the number of cards exposed. The players all share the same river card despite their choice of community card group, and before the river card is exposed, players know not only four of their own community cards, but those of their opponents as well, which might differ from their own.

The game includes a mandatory starting bid placed by all participating players before a single card is dealt, eliminating the game's participation being based solely on the probabilities during the distribution of the hole cards. Instead, the present method emphasizes players' focus on recognizing and selecting a favorable community card group to play their hand.

The game can include players' bids using a cyber token, which could be procured online for a commission, or could even be traded between players, with any inherent value of the token based on the game's popularity, token circulation, and game's participation.

The game can include dealing two cards to at least two players, and five community cards face-down in the community card area in a crisscross pattern. The game can include dealing four cards face-up in the community card area in a random order to the outermost points of the five face-down community cards. The game can include the players selecting a five-card community group from six available community groups when any group contains two face-up cards. This can be accomplished during or after the random dealing sequence of the final four community cards face-up, depending on the version of the game played. Players not selecting one of the six five-card community groups containing two face-up cards can elect to use the five face-down community cards as their five-card community group.

The method can include at least three rounds of bidding in a hand, and determining the best five-card poker hand from at least two players; the best five-card poker hand comprising between zero and two cards from the two cards dealt to the player, and at least three cards from the five-card community group chosen by the player. The winner can be declared as the player who has the highest volume of poker tokens at the end of play of a designated series of hands.

Other objects, features and advantages of the invention will be understood from the DETAILED DESCRIPTION of the preferred embodiments taken with the drawings.

Figure 1:
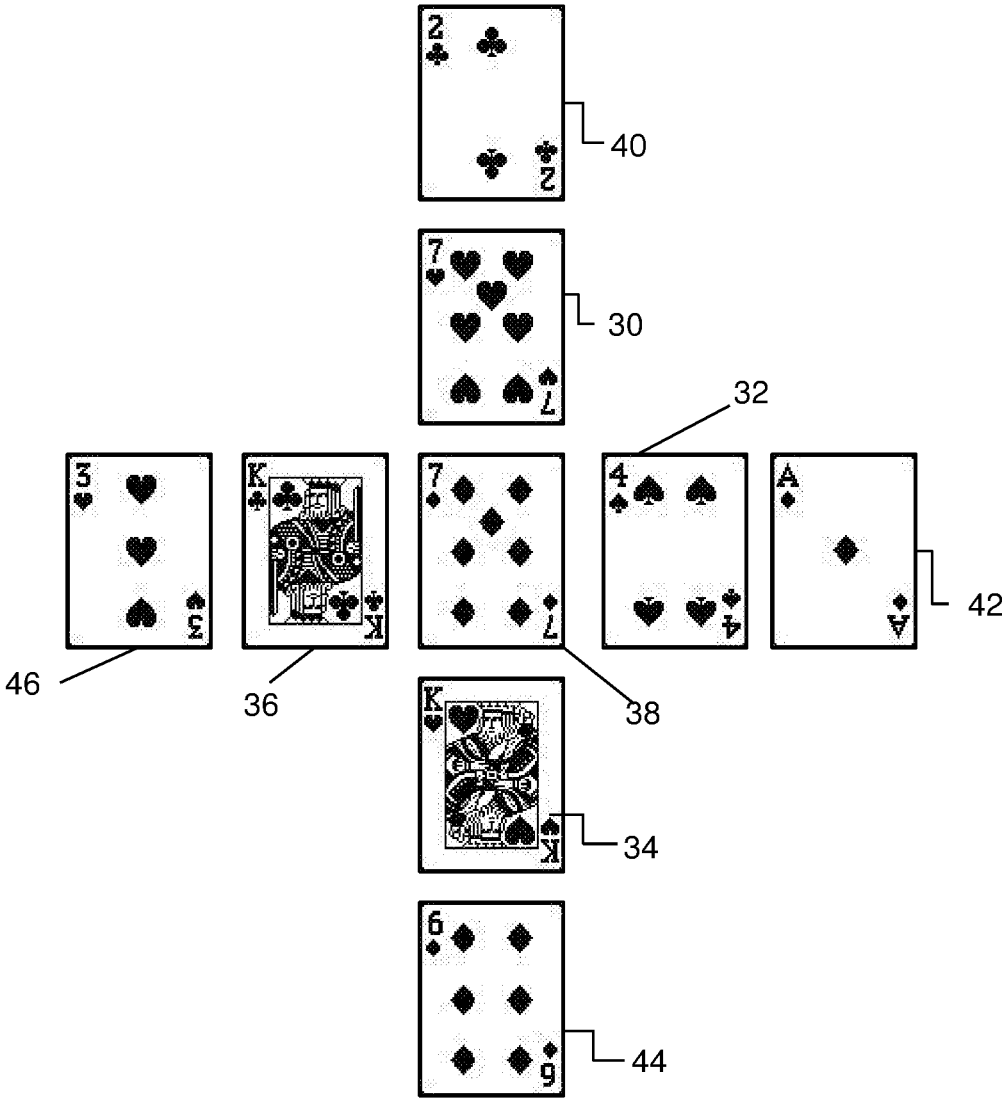
FIG. 1 illustrates the top view of the preferred community card placement after all community cards are exposed.

The figures depict embodiments of the present invention for illustration only. One skilled in the art will readily recognize from the following discussion that alternative embodiments of the structures and methods illustrated may be used without departing from the principles of the invention described here.

In the description that follows, similar components of the drawings are denoted throughout the specification and drawings with the same numerals and alpha letters, respectively. The numerals and alpha letters representing five-card community groups and playing areas in the DETAILED DESCRIPTION of the embodiment are for illustrative purposes of the embodiment only, and other letters, numerals, or symbols can be substituted for game play.

The drawing figures are not drawn to scale for purposes of clarity and for purposes of understanding the method. The application itself, and a preferred mode of use, and further objectives, will be best understood by reference to the following detailed description of the illustrative embodiments when read in conjunction with the accompanying drawings.

DETAILED DESCRIPTION

The description set forth below in conjunction with the drawings is intended to describe the preferred embodiments of the invention and is not intended to imply the only forms in which the invention can be used. The description includes a possible sequence of steps for using the illustrated embodiments. Equivalent functions can be achieved by different embodiments and comparable steps encompassed within the present invention.

Overview

The present application relates to an improved community poker-type game that provides players with the ability to form the best poker hand from multiple five-card community groups. From the illustrative embodiment the players have two cards dealt to them, and seven unique five-card community groups from within nine community cards which the players can form the best five-card poker hand. Game play begins with the deal of two cards to at least two players. Five community cards are then dealt face-down in a crisscross pattern. The players select a five-card community group during, or after, (depending on the version of the game played) the deal of the last four community cards face-up to the outermost points of the five face-down community cards. Provided in embodiments is a method wherein players can choose a five-card community group after viewing two of the five cards of six of the seven available five-card community card groups.

The best five-card poker hand is determined for each player when at least two players stay in the game. The best five-card poker hand can include between zero and two cards from the two cards dealt to each player and at least three cards from the five-card community card group selected by the player.

Variations to the provided illustrative embodiment are described herein. From those embodiments, many advantages will become clear over Texas Hold'em or other comparable community card poker games.

The present application describes a method of playing a community poker card game using a single standard deck of 52 playing cards. The implementation of the game can be accomplished on several platforms such as a card table, game board, hand-held device, computer, or other casino video machine. The hand-held device, computer or other casino video machine preferably has an interface. The interface can be, for example, a command line interface, a graphical user interface (GUI), a natural user interface (NUI) a touch user interface (TUI), a web based interface, or an application programming interface.

The standard betting method, comprising the "big blind" and "small blind," is not used in the present invention to establish the minimum by which any player must call to stay in the hand. Instead, the present invention is played with tokens, of no particular monetary value, in the form of a bid, with the minimum bid being equivalent to or greater value than the game's initial ante, or starting bid.

A winning hand wins the total bids less the house commission. It is the game's objective at the end of a designated series of hands' play to have accumulated the most tokens.

There are many advantages to using a computer platform which can include programming the computer to alert the players of the availability of five-card community groups on a revolving screen, resulting from the random deal of the last four community cards. The players can select an available group by touching a designated area of the screen within a timed-period. This can be accomplished without the need of a live dealer, demographically providing live play on the Internet between players living on different continents.

In the embodiment of the method the sequence of dealing the four face-up community cards varies from hand to hand. Therefore, the order of appearance of the eligible community card groups varies from hand to hand. The computer determines the order of eligible community card groups appearing through the sequence of dealing the four face-up community cards. The computer can incorporate a clock set to default to a player pass or fold if the player fails to select an eligible five-card community card group during a fixed-time. The timer can also be applied during bidding rounds.

Figure 17:
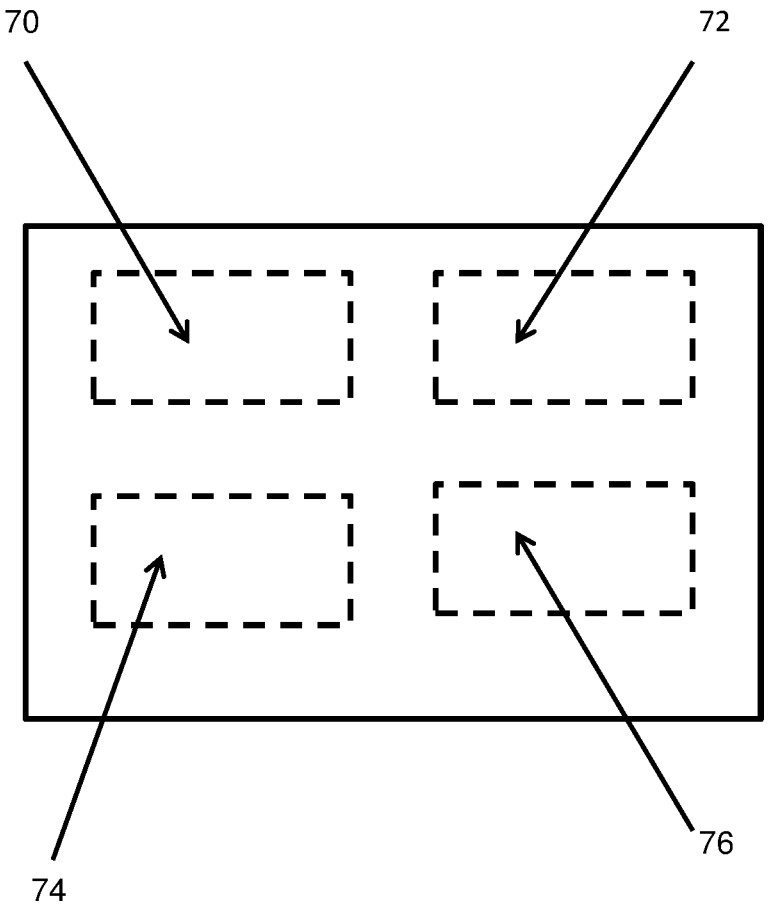
FIG. 17 illustrates a player's module used in computer play.

One version of the game utilizing a computer program embodiment begins with each player electronically placing a starting bid 76 which is displayed on the player's module as illustrated in FIG. 17. Bids are made using poker tokens. The type of action taken by the players, which includes starting bids, raises, calls or folds by the players are displayed in action box 74 of the players' modules along with the corresponding bid value, if any, in box 76. The player's name 70 and choice of five-card community group 72 are also displayed on the players' modules. The type of action play, in this case the starting bid 76, will appear on the module, for example in action box 74 along with its corresponding bid value. A starting bid is predetermined by the table's game rules and limits, and the starting bid is compulsory to participate in the hand. Two cards are electronically dealt to each player face-down after starting bids are placed.

Figure 2:
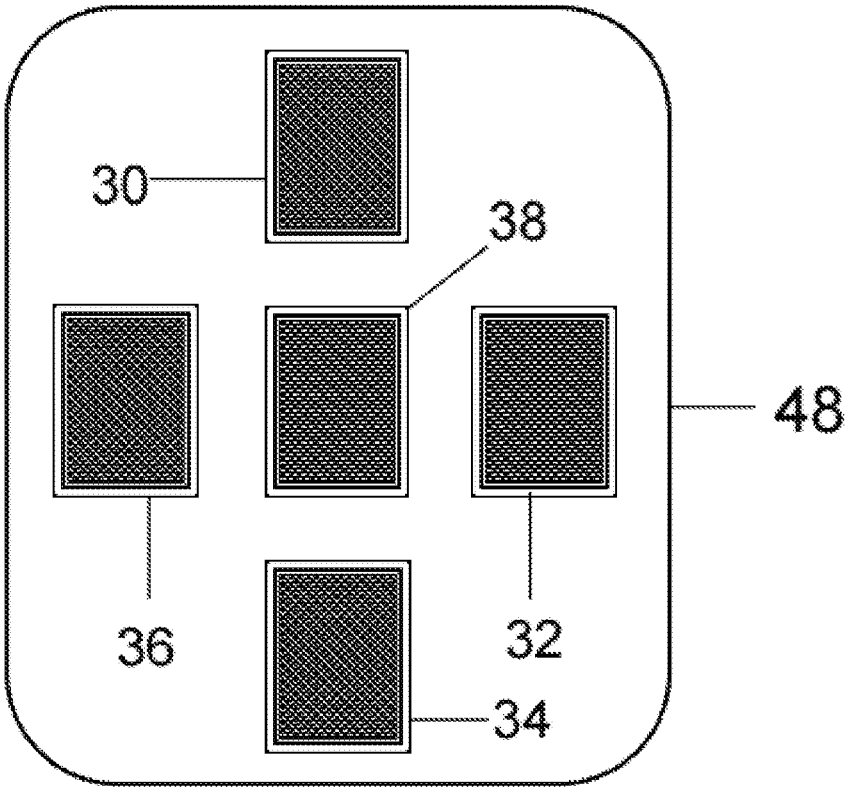
FIG. 2 illustrates the top view of the preferred community card placement after the first five community cards, a central river card and four paddle cards, are dealt face-down, showing the formed group 48, comprising the first five-card community group.

Next, community cards 30, 32, 34, 36, and 38, which form a first 5-card community group, are electronically dealt face-down in the community card area in a crisscross pattern as shown in FIG. 2. Community cards 30, 32, 34, and 36 are hereby defined as "paddle cards" and the center community card 38 is hereby defined as the "river card".

Figure 3:
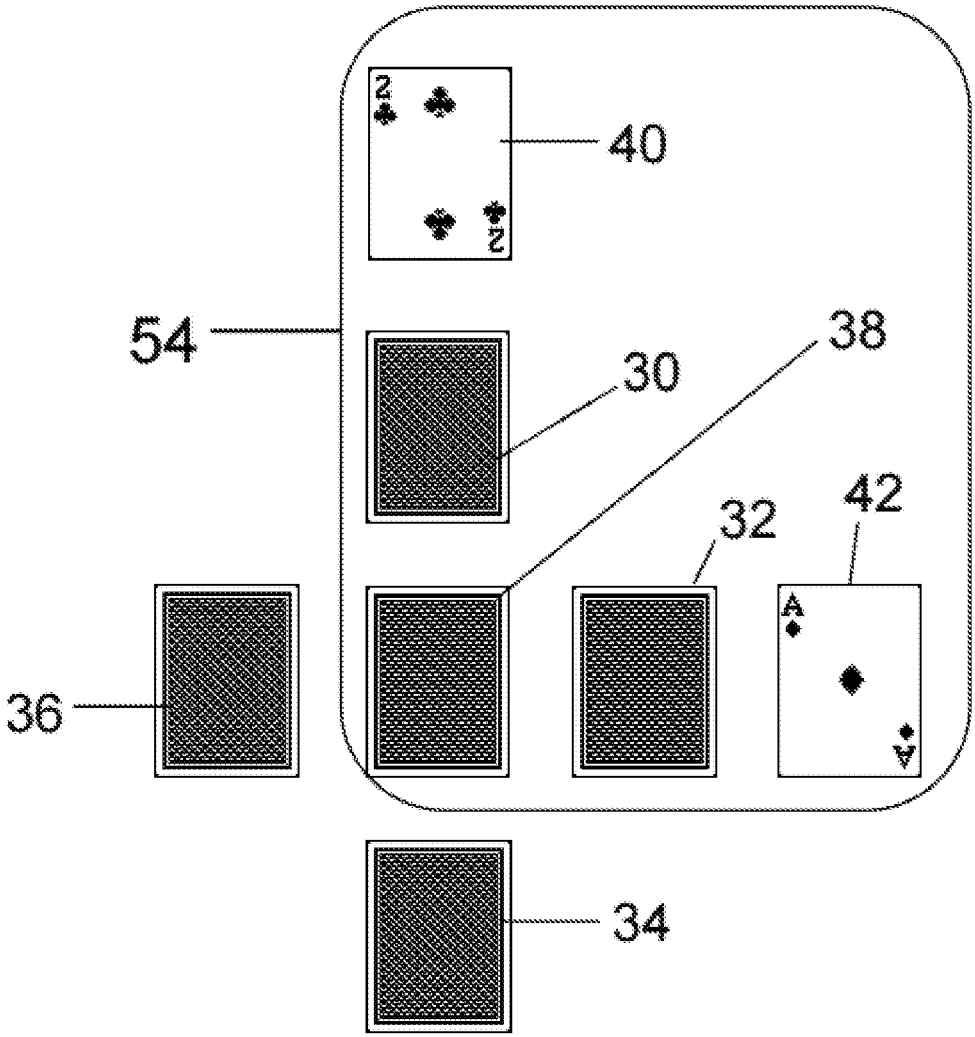
FIG. 3 illustrates a top view of the preferred community card placement after first and second face-up community cards are dealt each adjacent to respective paddle cards, thereby forming five-card community group 54.
Figure 4:
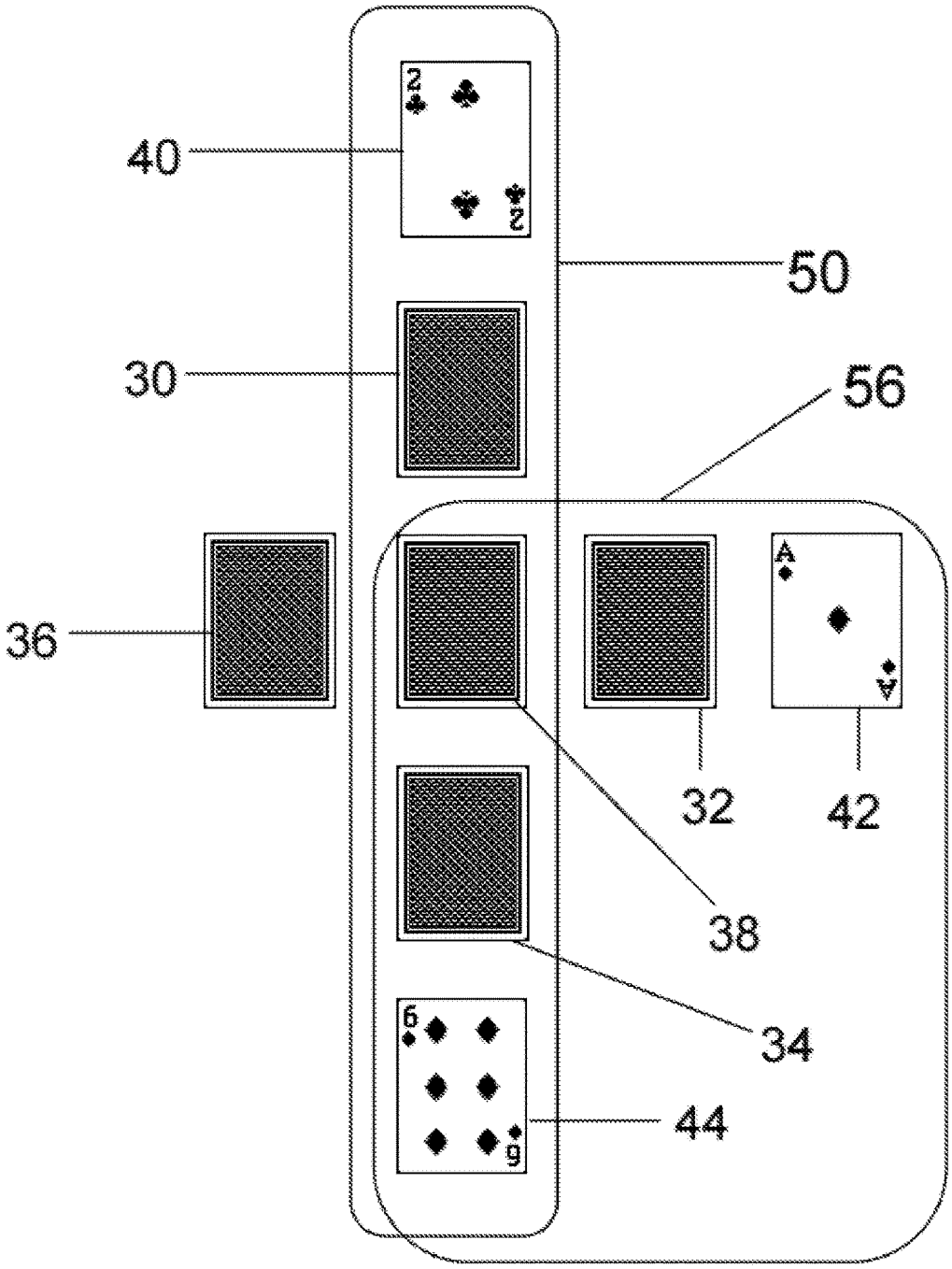
FIG. 4 illustrates a top view of the preferred community card placement after a third face-up community card is dealt adjacent to a paddle card, thereby forming five-card community groups 50 and 56.
Figure 5:
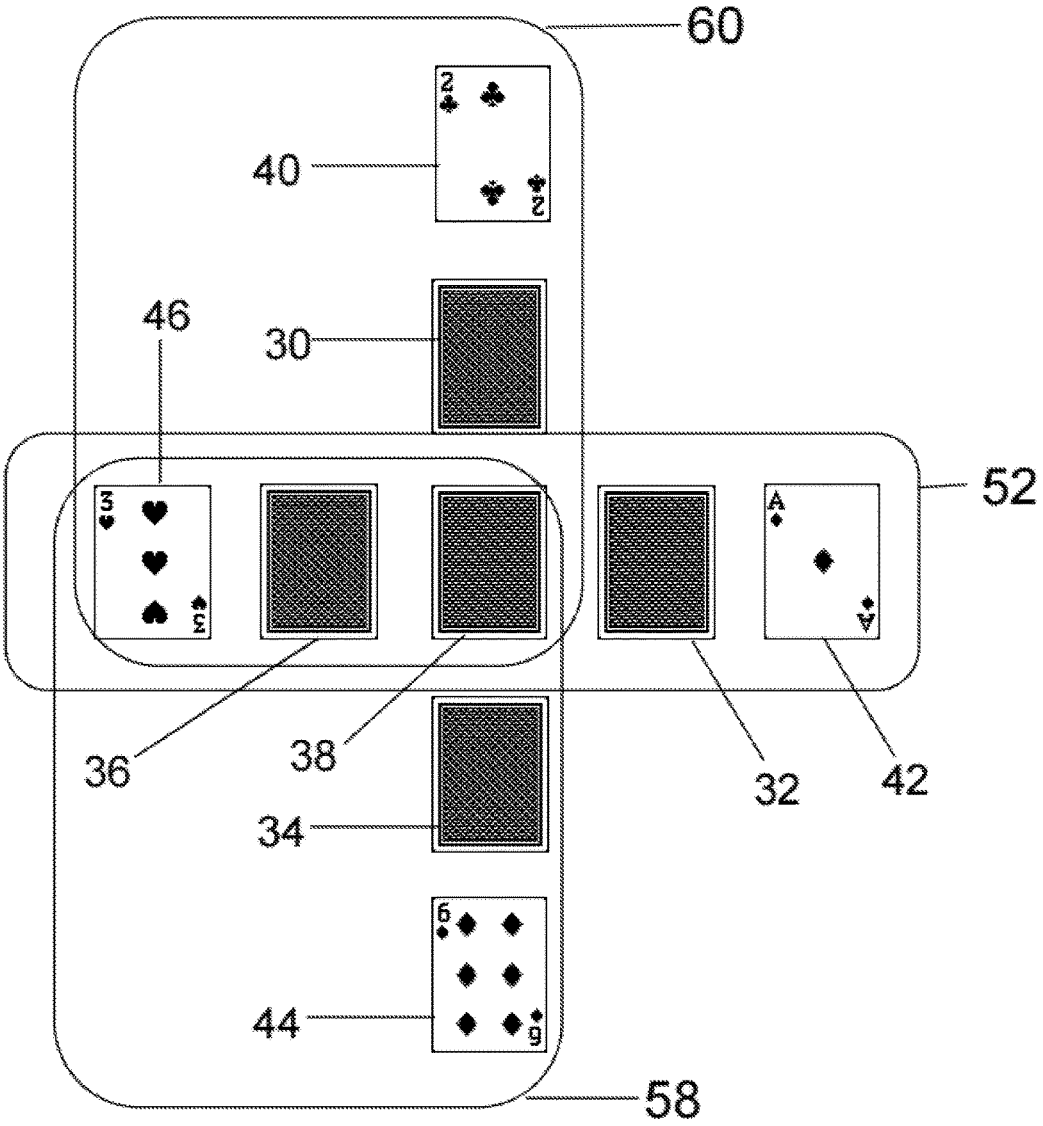
FIG. 5 illustrates a top view of the preferred community card placement after a fourth face-up community card is dealt adjacent to a paddle card thereby forming five-card community groups 60, 52, and 58.
Figure 7:
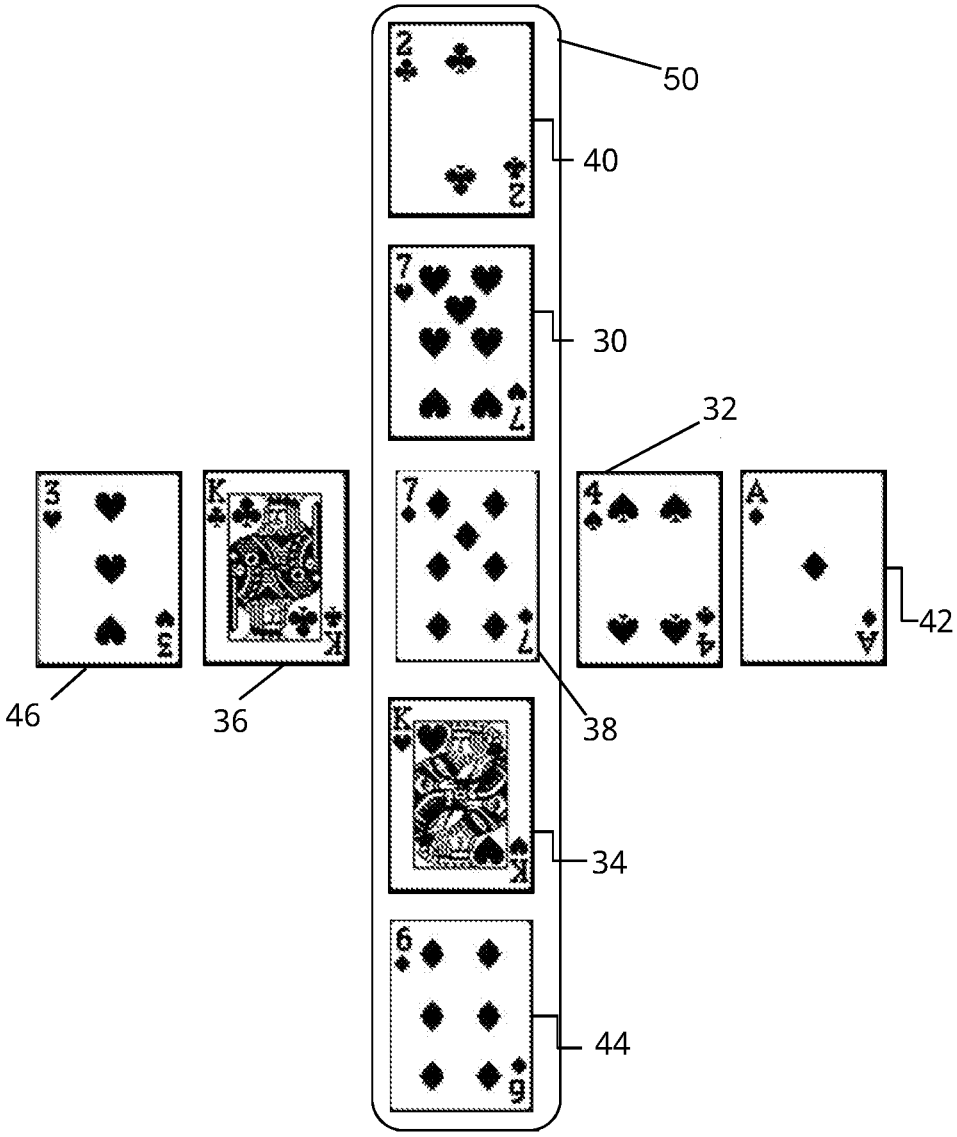
FIG. 7 illustrates a top view of the preferred community card placement showing one of the seven possible five-card combinations that could be used in a five-card community hand.
Figure 9:
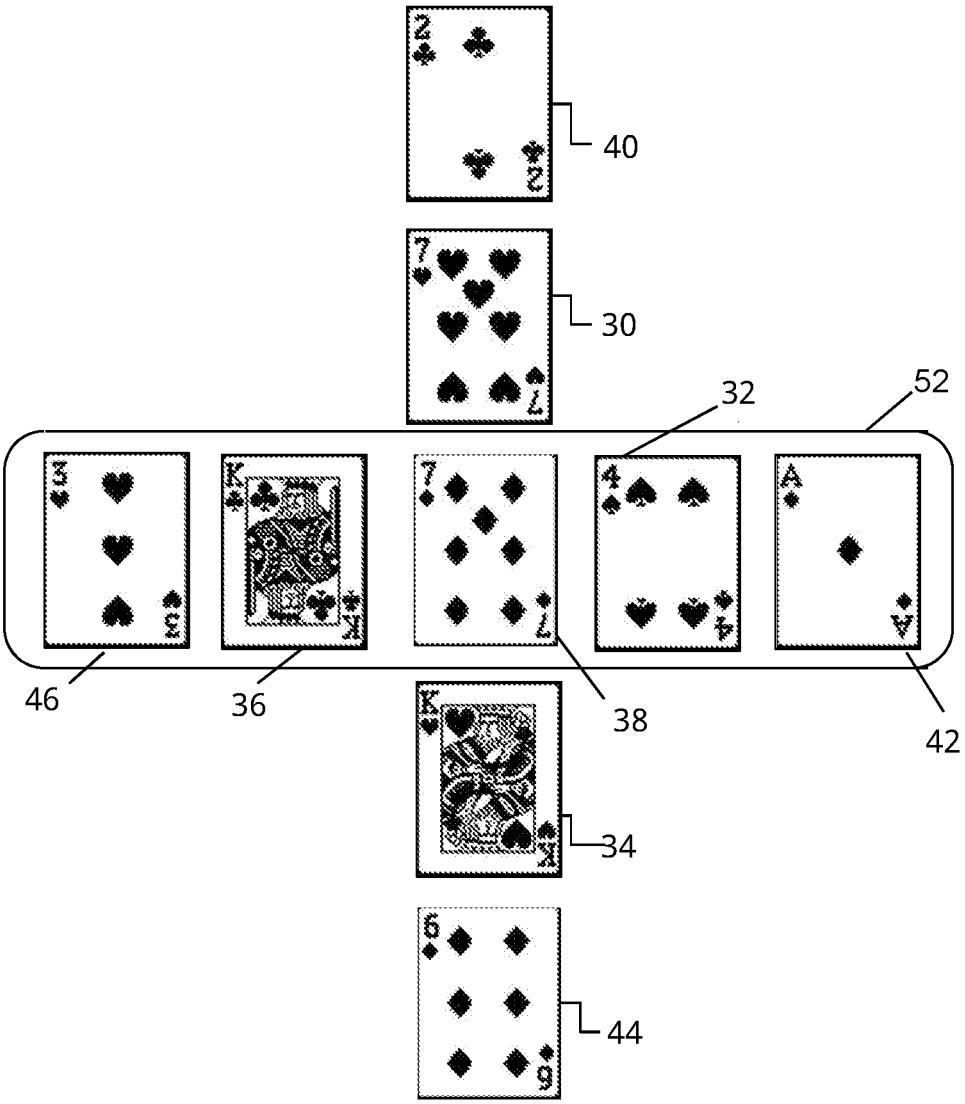
FIG. 9 illustrates a top view of the preferred community card placement showing another of the seven possible five-card combinations that could be used in a five-card community hand.
Figure 10:
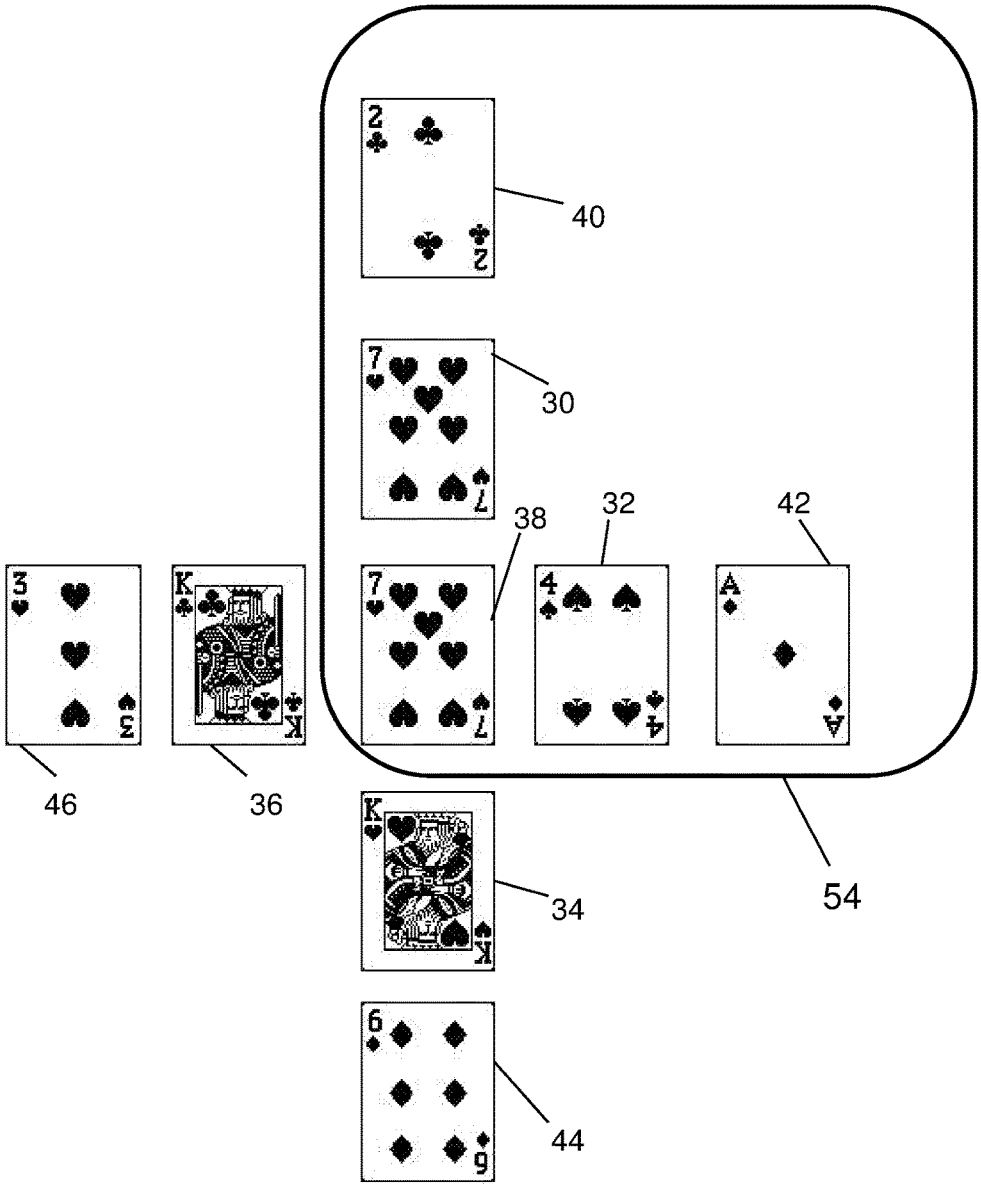
FIG. 10 illustrates a top view of the preferred community card placement showing another of the seven possible five-card combinations that could be used in a five-card community hand.
Figure 11:
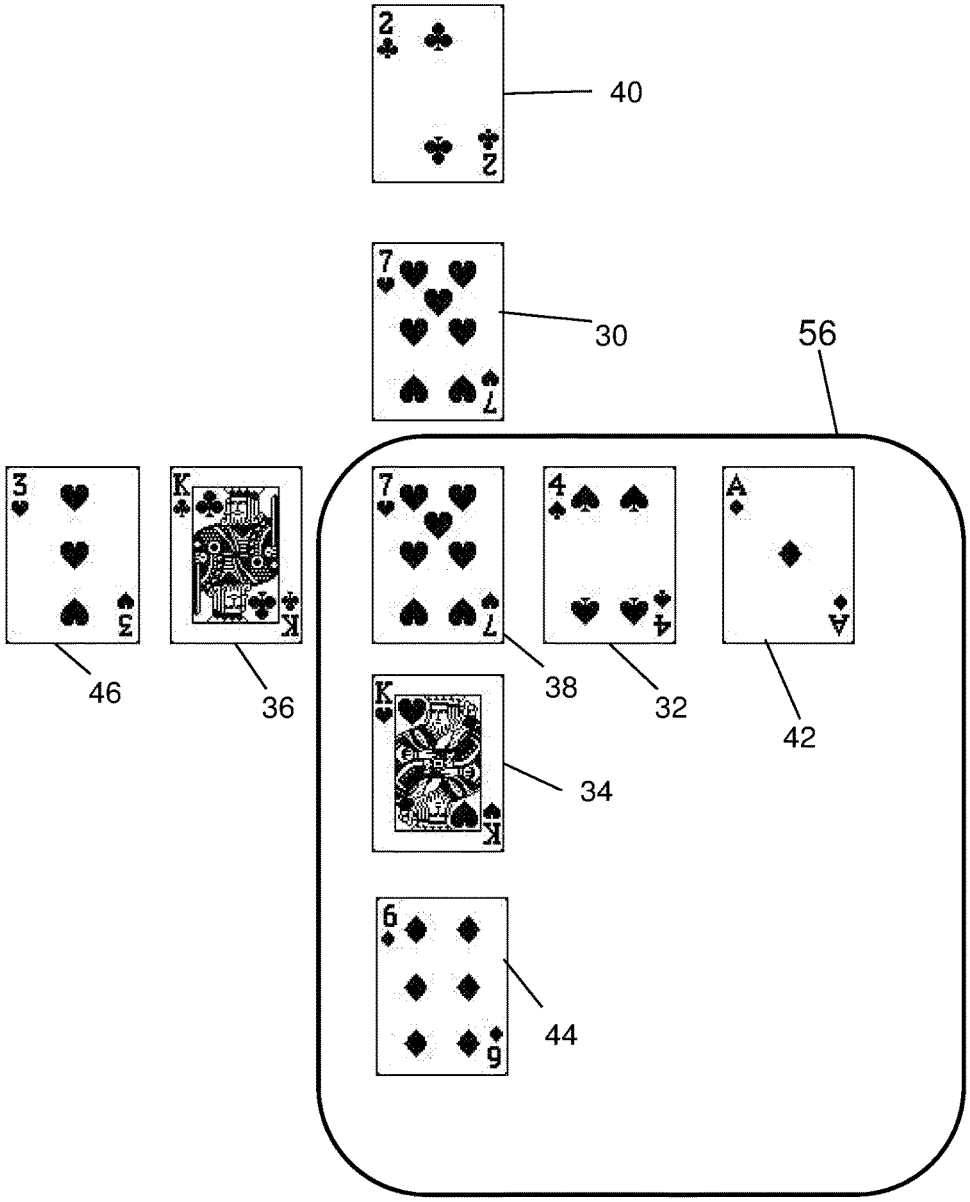
FIG. 11 illustrates a top view of the preferred community card placement showing another of the seven possible five-card combinations that could be used in a five-card community hand.
Figure 12:
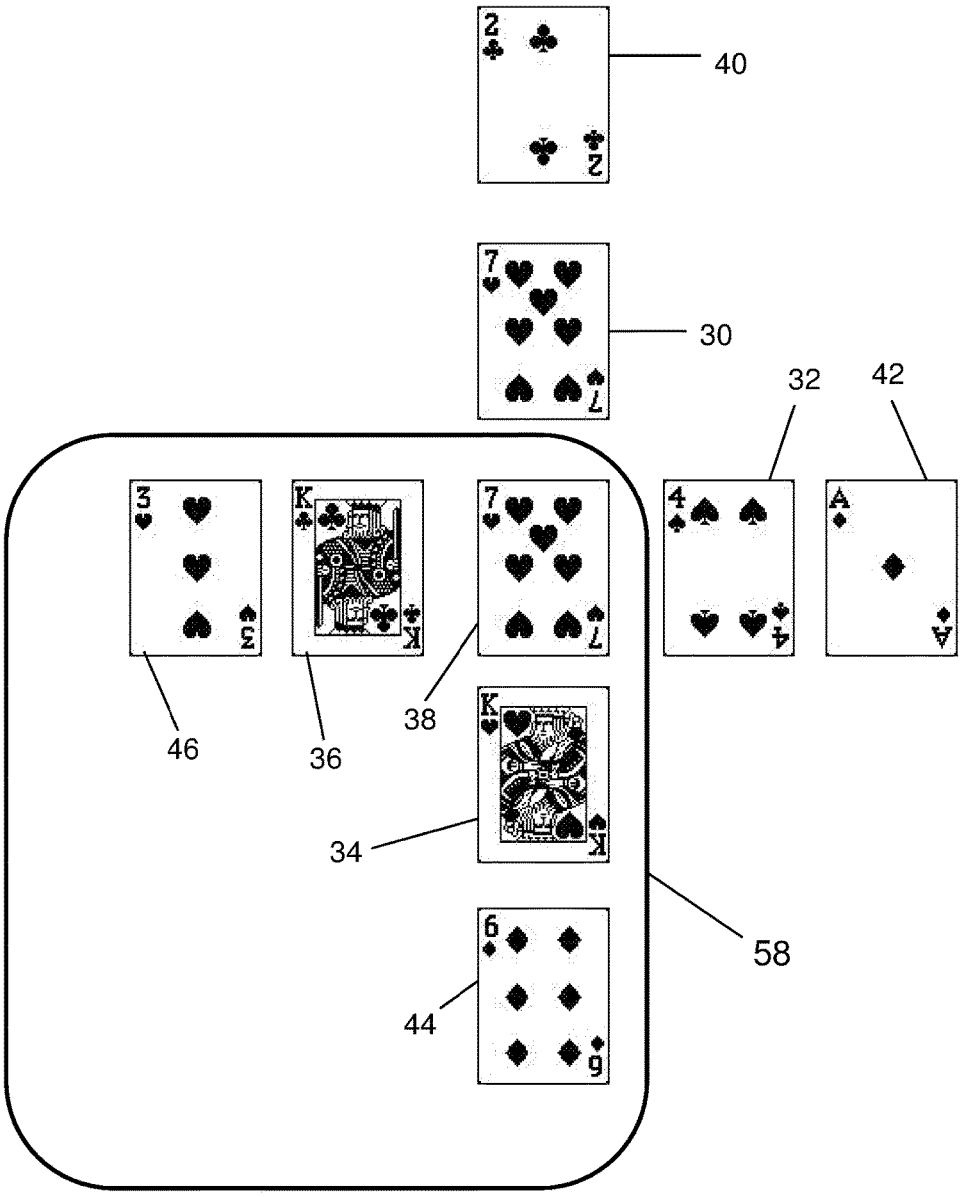
FIG. 12 illustrates a top view of the preferred community card placement showing another of the seven possible five-card combinations that could be used in a five-card community hand.
Figure 13:
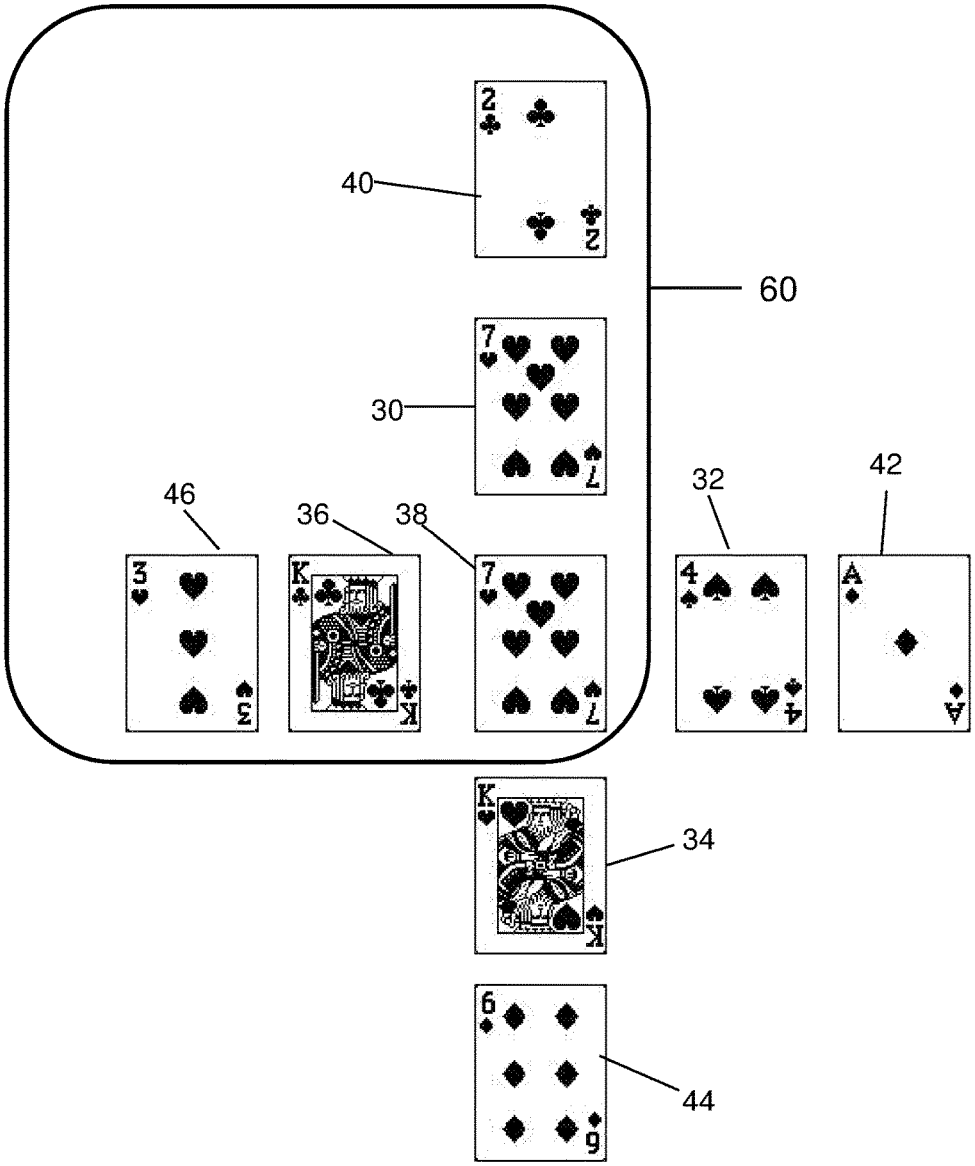
FIG. 13 illustrates a top view of the preferred community card placement showing another of the seven possible five-card combinations that could be used in a five-card community hand.

Next begins the first phase of the game comprising players electronically selecting their five-card community group during the electronic deal of the four community cards 40, 42, 44, and 46 as shown in FIG. 5 face-up in a 2-1-1 sequence as illustrated in FIGS. 3-5. These four community cards are defined in the invention as the "bucket cards". Five-card community groups become available to the players for selection when two bucket community cards appear within one of the following groups: community group 50 of cards comprising: 40, 30, 38, 34, and 44 as shown in FIG. 7; community group 52 of cards comprising: 46, 36, 38, 32 and 42 as shown in FIG. 9; community group 54 of cards comprising: 40, 30, 38, 32, and 42 as shown in FIG. 10; community group 56 of cards comprising: 42, 32, 38, 34, and 44 as shown in FIG. 11 community group 58 of cards comprising: 46, 36, 38, 34, and 44 as shown in FIG. 12; and community group 60 of cards comprising: 40, 30, 38, 36, and 46 as shown in FIG. 13. There are four available positions for respective placement of bucket cards as shown in FIG. 5. Each bucket card is placed such that when four bucket cards have been dealt, the crisscross pattern is radially symmetrical and comprises a vertical column of five cards and a horizontal row of five cards with the river card at the center of both the vertical column and the horizontal row. Irrespective of the order of dealing the bucket cards, every possible five-card community group will be comprised of two bucket cards and the river card with a paddle card situated between the river card and each bucket card.

This five-card community group selection process begins with the electronic random deal of two bucket community cards to any of the outermost points of the paddle community cards as illustrated in FIG. 3, generating a second five-card community group 54, as shown in FIGS. 3 and 10. There are twenty-four combinations in which the four bucket cards can be dealt 2-1-1. The positions of the second through seventh five-card community groups generated during dealing of the four bucket community cards depends upon the positions in which the first, second, third, and fourth bucket cards are placed.

In order for a five-card community group to be eligible for selection by players it must have two bucket cards showing within that five-card community group. For illustrative purposes, after bucket cards 40 and 42 are dealt as Illustrated in FIG. 3, group 54 becomes eligible because that group now has two bucket cards exposed.

Figure 8:
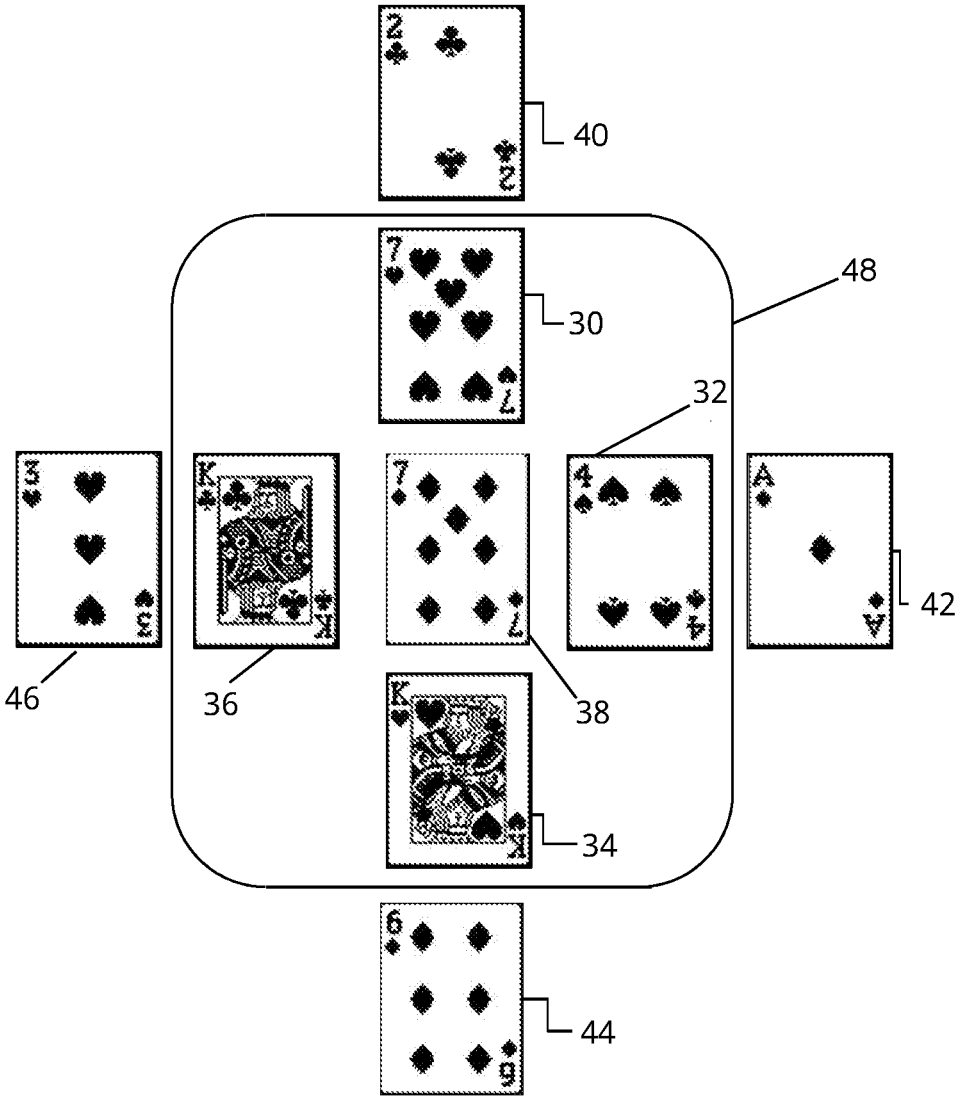
FIG. 8 illustrates a top view of the preferred community card placement showing another of the seven possible five-card combinations that could be used in a five-card community hand.

Players who pass on any five-card community group when it becomes available cannot choose to use that group after the next bucket card is dealt. After all of the bucket cards are dealt, players who have not selected one of the six five-card community groups containing two bucket cards can select community group 48, comprising community cards 30, 32, 34, 36, and 38 as illustrated in FIG. 8. Players selecting community group 48 do so without any of their five-card community group's cards exposed. Community group 48 can be an ideal option for players dealt superior hole cards, but unable to match them with one of the other six five-card community groups for play.

Figure 15:
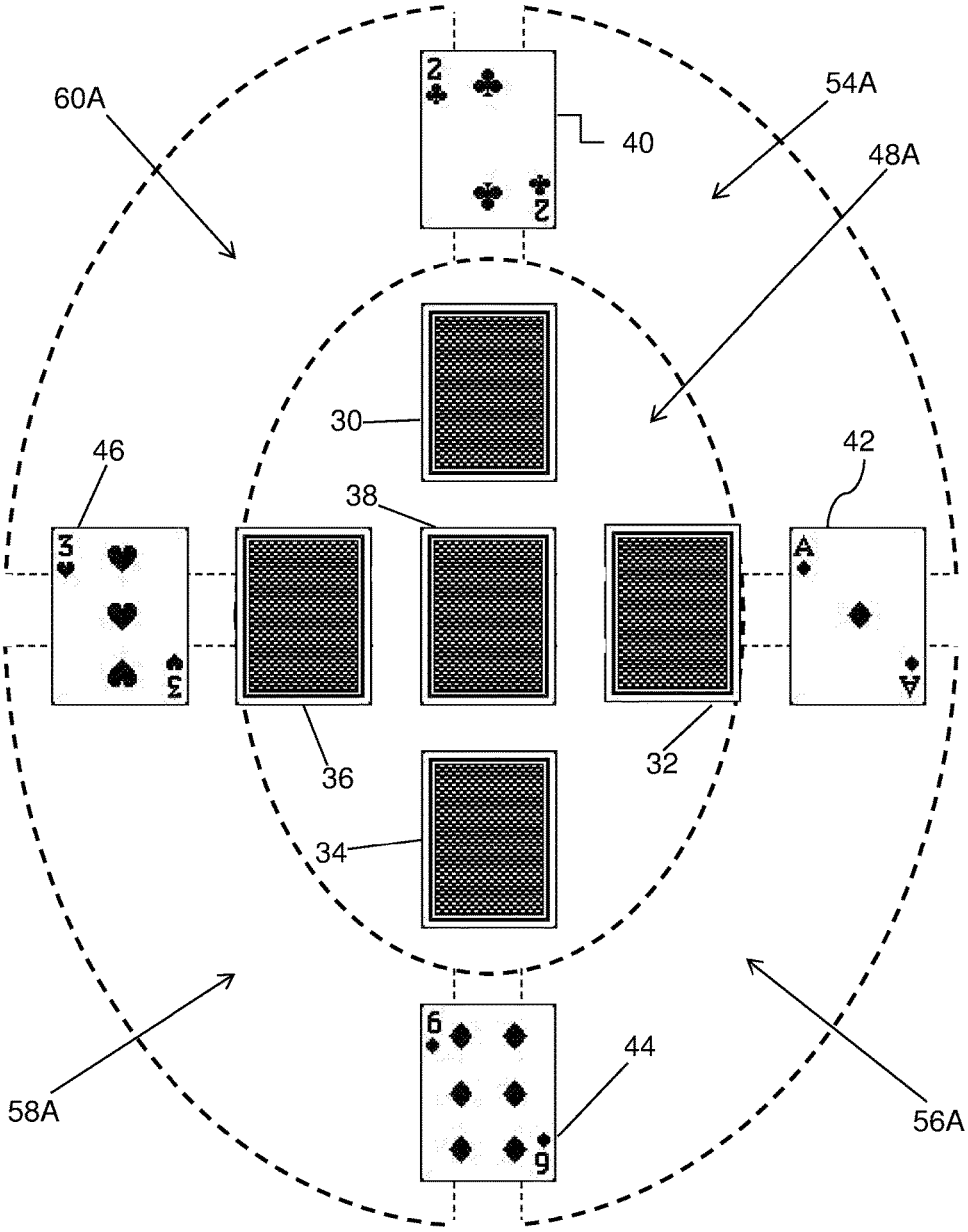
FIG. 15 illustrates a front view of the screen of the preferred embodiment for video or computer play, displaying five of the seven five-card community options.
Figure 16:
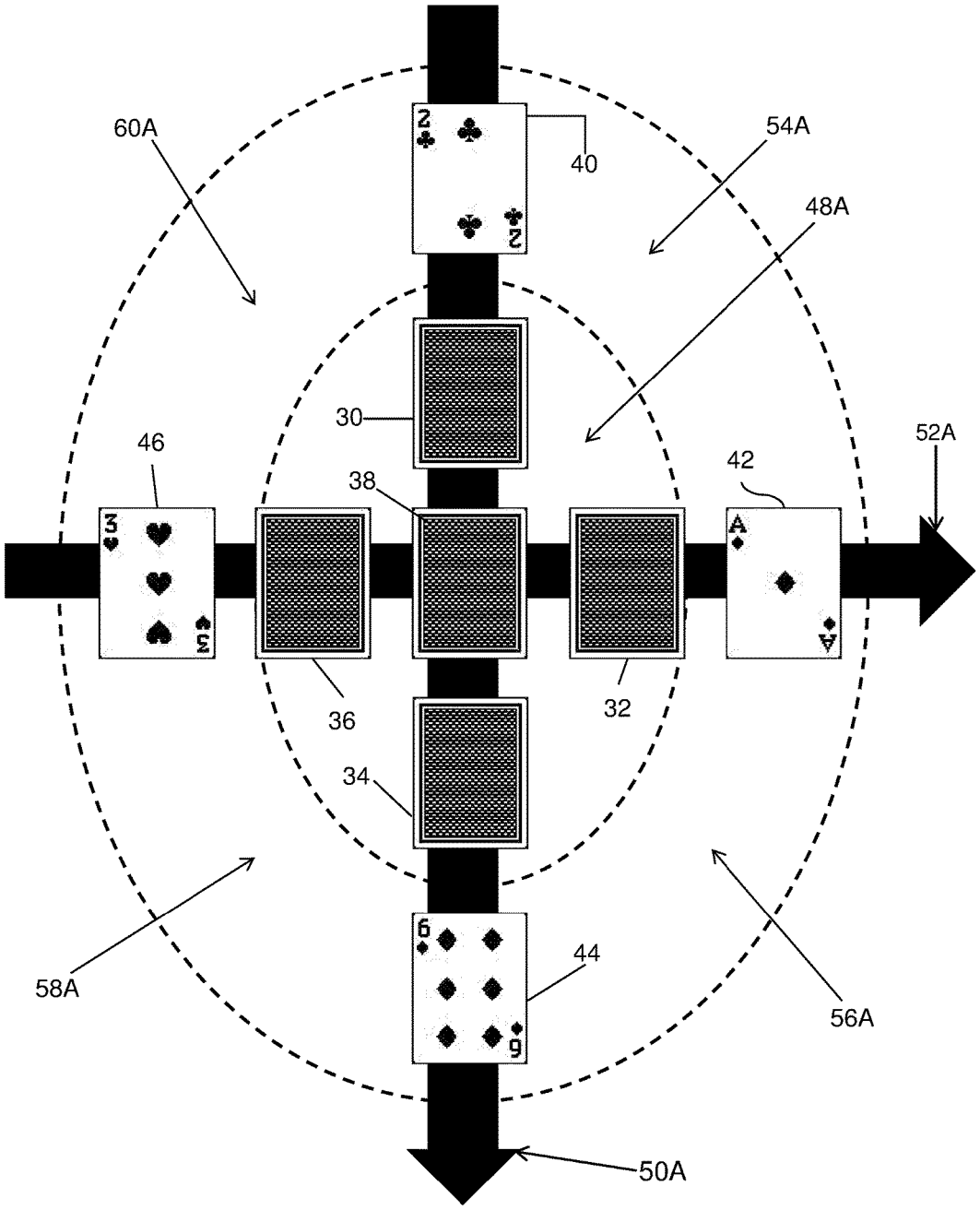
FIG. 16 illustrates a front view of the screen of the preferred embodiment for video or computer play, displaying seven five-card community options.

When community groups 48, 54, 56, 58, and 60 become available, the players are alerted by the illumination of areas 48A, 54A, 56A, 58A and 60A respectively, on the computer screen as shown in FIG. 15. When community groups 50 and 52 become available arrows 50A and 52A appear as illustrated in FIG. 16. The bucket card(s) which causes these groups to become available illuminate on the screen as well.

For illustrative purposes, and to demonstrate play, in the present embodiment community bucket cards 40 and 42 are electronically dealt first as shown in FIG. 3 causing five-card community group 54 to become available. Community group 54 is available to the players because it has two bucket cards showing. The area 54A as shown in FIGS. 15-16 can automatically illuminate indicating to the players that community card group 54 is available, and bucket community cards 40 and 42 will be illuminated, indicating that these two bucket cards created the availability of community group 54. A clock can be used to allow time for players to select eligible groups after the deal of each bucket card. The players can select community group 54 by signaling with a keystroke or touching area 54A via an interface of a touch-capable screen of a device. The players' choice of the five-card community group can be signaled by the appearance of the player's starting bid token, with identifying name, initials or avatar, within community card area 54A. The player's choice of five-card community group 72 will also be displayed in the player's module. If any player passes on five-card community group 54, that player cannot choose five-card community group 54 after the next bucket community card is dealt, which occurs after the expiration of an allotted time. Players selecting a group after the first two bucket cards are dealt, in this case community group 54, have the option to initiate an optional bidding round for a value not less than the value of the starting bid starting with the player closest to the left of the dealer marker. Once a player selects a five-card community group the player is locked-in to that group for the duration of the hand.

For illustrative purposes, and to demonstrate play, the next bucket community card 44 is electronically dealt as illustrated in FIG. 4 causing two additional five-card community groups to become available for the player to choose from. In the present illustration they are five-card community group 50 and five-card community group 56. Area 56A will become illuminated and arrow 50A will appear, indicating to the players that five-card community groups 50 and 56 are now available. The bucket card 44 causing these groups to become available will be illuminated. Community groups 50 and 56 are available because those two groups now have two bucket cards showing. Players can select five-card community group 50 by signaling with a keystroke or touching area 50A via an interface of a touch screen to select this group, or the player can select five-card community group 56 by signaling with a keystroke or by touching the corresponding area 56A via an interface of a touch screen. If one of the two five-card community groups are chosen, the players' starting bid token with name, initials or avatar inscribed will appear in the corresponding community card area 50A or 56A, as well as in the players' module 72. Players passing on community groups 50 or 56 cannot choose community groups 50 or 56 after the next bucket community card is dealt. Players choosing either group 50 or 56 also have the option to initiate an optional round of bidding at this time.

Lastly, in the embodiment illustration, and to demonstrate play, after bucket community card 46 is electronically dealt face-up as illustrated in FIG. 5, three additional five-card community groups become available to the players. They are five-card community groups 58, five-card community group 60, and five-card community group 52. Players can be alerted as to the availability of these five-card community groups by the illumination of areas 58A and 60A, along with the appearance of arrow 52A. The bucket card 46 which caused these groups to appear will also be illuminated. Five-card community groups 58, 60 and 52 are available because those three five-card community groups now have two bucket cards showing within those groups. Players can select five-card community group 52 by signaling with a keystroke or touching area 52A via an interface of a touch screen to select this group, or players can select five-card community group 58 by signaling with a keystroke or by touching area 58A via an interface of a touch screen, or players can select five-card community group 60 by signaling with a keystroke or by touching area 60A via an interface on a touch screen. Players' starting bid token with name, initials or avatar inscribed can appear in the corresponding community group areas 58A, 60A, or 52A chosen respectively, as well as in the players' module 72.

Players who have not chosen one of the six aforementioned five-card community groups consisting of two bucket cards, can choose to use the four paddle cards 30, 32, 34 and 36 along with the river card 38 as their five-card community group 48 as shown in FIG. 8 by electronically signaling with a keystroke or by touching area 48A via an interface on a touch screen, or electronically signaling to fold, losing their starting bid. Players selecting five-card community group 48 will have their choice designated by their starting bid token with name, initials or avatar inscribed appearing in community card area 48A, as well as on the players' module 72.

There are three mandatory bidding rounds wherein the players can bid comprising: after the nine community cards have been dealt and the players have selected a five-card community group; after the four paddle community cards 30, 32, 34, and 36 are exposed simultaneously; and after the river card 38 is exposed. Players' type of action: bid, call, raise, check or fold 74, and corresponding value 76, if any, can be shown in the players' module.

After all players select their five-card community group, the first round of mandatory bidding commences. The players electronically place a bid consisting of not less than the value of the starting bid, or fold wherein the folding players lose their starting bid. The bidding round can include the round commencing with a bid from the player to the immediate left of the dealer marker followed by the next player seated clockwise, and could include raises, calls, checks, or folds. Raise bids can be allowed in all rounds of bidding. A maximum of three raises per each round of bidding can be permitted. A player can choose to "check" and pass the action to the next player in the hand if no bidding action occurred before his or her turn to bid in a bidding round.

Figure 6:
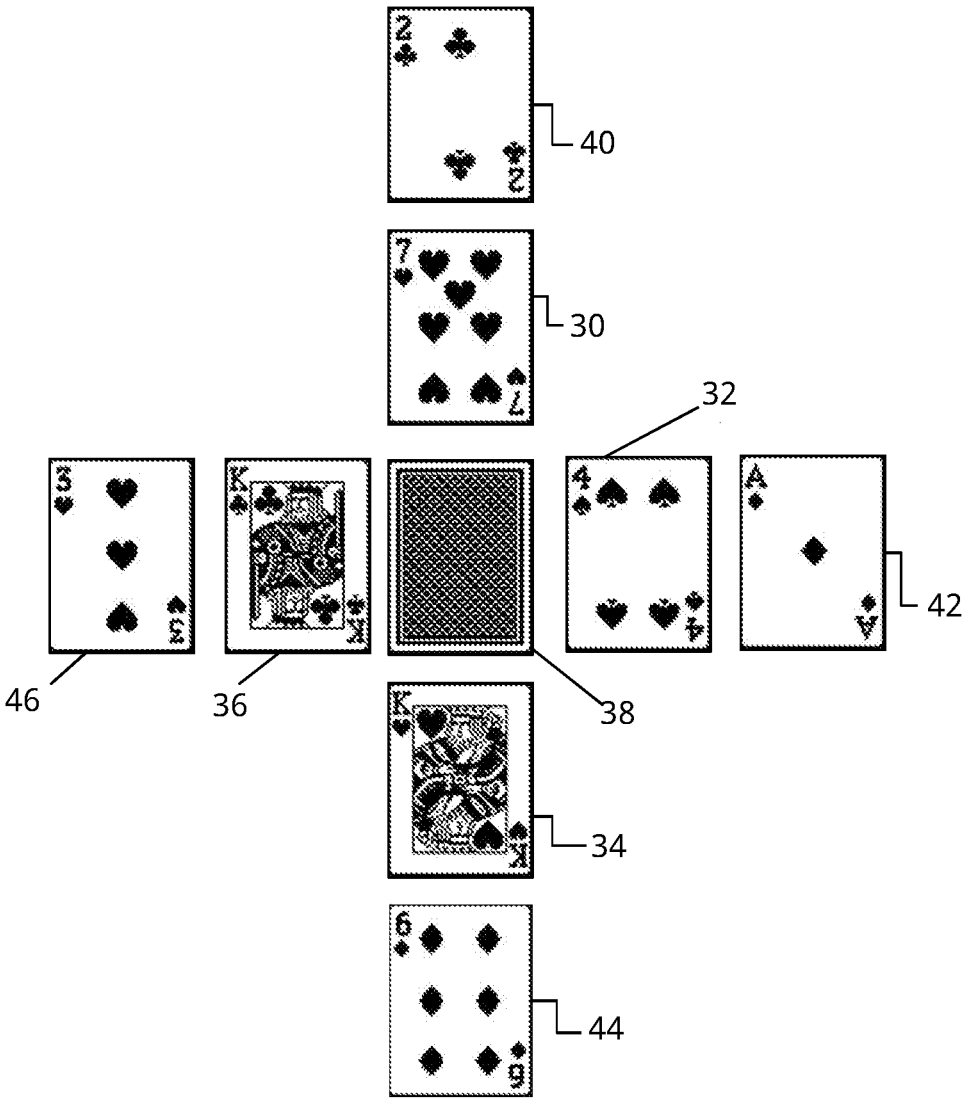
FIG. 6 illustrates a top view of the preferred community card placement after the four face-down community cards surrounding the face-down center card are exposed simultaneously.

Next, paddle cards 30, 32, 34 and 36 are electronically exposed simultaneously as illustrated in FIG. 6. Then the second round of bidding can begin. The players place a bid, or fold wherein the folding players lose their bids previously placed. The bidding round can include the round commencing with a bid from the player to the immediate left of the dealer marker, followed by a bid from the next player seated clockwise, and could include bids, checks, raises, and calls.

Finally, if at least two players stay in the hand, the center river card 38 is electronically exposed as illustrated in FIG. 1. A final round of bidding occurs after the river card 38 is exposed. The final bidding round can include a bid from the player remaining in the game closest to the left of the dealer marker followed by a bid from the next player seated clockwise, and could include raises, calls, checks, and folds. The players electronically place a bid, call, raise, or fold wherein the folding players lose their bids previously placed.

The showdown occurs after the final round of bidding concludes, whereas the remaining players' hole cards are electronically exposed. The computer electronically combines of at least two players as few as zero and as many as two cards initially dealt to each player with at least three cards of the five-card community group chosen by the player. Thereafter, the computer determines who has the highest ranking five-card poker hand out of the remaining players. The player having the highest ranking poker hand wins the total bid by the players in the hand less the house commission.

Another version utilizing a computer program embodiment of the game begins with each player electronically placing a starting bid 74 which value 76 appears in the players' modules. The starting bid is predetermined by the table's game rules and limits, and is compulsory to participate in the hand. The type of action 74 by the players, in this case the starting bid, can be displayed in the players' modules corresponding to the players' location, along with identity 70 of player and five-card group selected 72. Two cards are then electronically dealt to each player face-down.

Community cards 30, 32, 34, 36, and 38 are electronically dealt face-down in the community card area in a crisscross pattern as shown in FIG. 2. Then community bucket cards 40, 42, 44, and 46 are all electronically randomly dealt, consecutively, face-up as shown in FIG. 5.

After the four bucket community cards 40, 42, 44 and 46 are dealt, players electronically select a five-card community group comprising: 48, 50, 52, 54, 56, 58, or 60 as illustrated in FIGS. 7-13 to play their hand, or fold, losing their starting bid. The players can electronically signal their selection via keystroke or by touching corresponding areas 48A, 50A, 52A, 54A, 56A, 58A, or 60A via an interface on a touch screen as illustrated in FIGS. 15-16. Players' starting bid tokens with initials, name, or avatar inscribed can electronically appear in the corresponding community groups areas 48A, 50A, 52A, 54A, 56A, 58A, or 60A on the screen respectively, as well as in the players' module 72 indicating players' choices of five-card community group.

After all players select their five-card community group, the first round of mandatory bidding can commence. The players electronically place a bid consisting of not less than the value of the starting bid, or fold, wherein the folding players lose their starting bids. The bidding round can include the round commencing with a bid from the player to the immediate left of the dealer marker followed by the next player seated clockwise, and could include raises, calls, checks, or folds. Raise bids are allowed in all rounds of bidding. A maximum of three raises per each round of bidding can be permitted. A player can choose to "check" and electronically pass the action to the next player in the hand if no bidding action occurred prior to the player's turn to bid in a bidding round.

Next, paddle cards 30, 32, 34 and 36 are electronically exposed simultaneously as illustrated in FIG. 6. Then the second round of bidding begins. The players electronically place a bid, or fold wherein the folding players lose their bids previously placed. The bidding can include the round commencing with a bid from the player to the immediate left of the dealer marker, followed by a bid from the next player seated clockwise, and could include raises, checks and calls.

Finally, the center river card 38 is electronically exposed as illustrated in FIG. 1. A final round of bidding occurs after the river card 38 is exposed, and can include a bid from the player to the immediate left of the dealer marker followed by a bid from the next player seated clockwise, and could include raises, calls, checks, and folds. The players electronically place a bid, call, raise, or fold wherein folding players lose their bids previously placed.

The showdown occurs after the final round of bidding, whereas the remaining players' hole cards are electronically exposed. The computer electronically combines of at least two players as few as zero and as many as two cards initially dealt to each player with at least three cards of the five-card community group chosen by the player. Thereafter, the computer determines who has the highest ranking five-card poker hand out of the remaining players. The player having the highest ranking poker hand wins the total bid by the players in the hand less the house commission.

Figure 14:
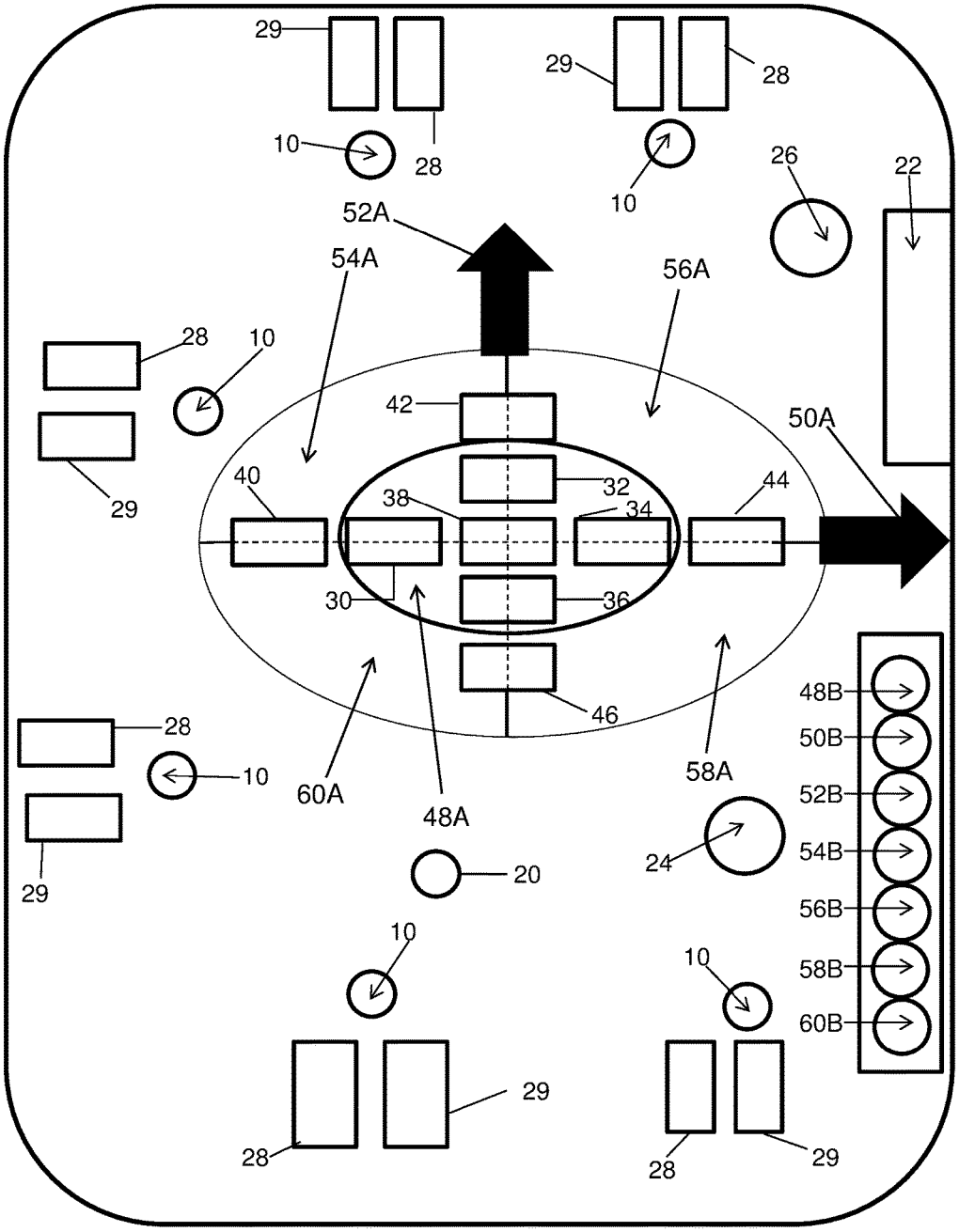
FIG. 14 illustrates a table top view of the preferred embodiment for casino or home play.

Another version of the method can be applied in an embodiment utilizing a game board or table layout as shown in FIG. 14. The dealer has a plurality of circled areas 48B, 50B, 52B, 54B, 56B, 58B, and 60B used to indicate available five-card community groups to the players. The community card area comprises nine community cards 40, 42, 44, 46, 30, 32, 34, 36, and 38 as shown in FIG. 14 comprising seven five-card community groups 48, 50, 52, 54, 56, 58, and 60 as illustrated in FIGS. 7-13. Players can select one of the aforementioned five-card community groups to use by sliding or other physical movement, their starting bid token from bidding area 10 to one of the community card areas 48A, 50A, 52A, 54A, 56A, 58A, or 60A, respectively as illustrated in FIG. 14.

The table as shown in FIG. 14 provides for players' two hole cards 28 and 29, a dealer marker 20, token rack 22, area for discarded playing cards 26, and the players' total tokens bid during the hand 24.

The players place their mandatory starting bid and are dealt two hole cards 28 and 29 face-down, and then the five community cards 30, 32, 34, 36, and 38 are dealt face-down in the community card area 48A in a crisscross pattern as shown in FIG. 14.

Next, two bucket community cards are dealt face-up to any of the four outermost points of the paddle community cards randomly. After the first two bucket cards are dealt, and concluding with the fourth bucket card, six eligible five-card community groups appear which contain two community bucket cards. Players select their five-card community group when one or more five-card community groups appear which contain two bucket cards during the random deal of the bucket community cards 40, 42, 44, and 46 face-up. The players indicate their choice of five-card community group by physically moving or sliding their starting bid token from their bidding area circle 10 to the corresponding areas, 50A, 52A, 54A, 56A, 58A or 60A, of the community card area as illustrated in FIG. 14, or the player can signal to pass until the next bucket card is dealt.

The dealer can indicate which five-card community groups are available to the players after each bucket card is dealt by placing markers on the dealer's encompassed areas 48B, 50B, 52B, 54B, 56B, 58B, and 60B respectively, representing the corresponding five-card community groups 48, 50, 52, 54, 56, 58, or 60 available after each bucket card is dealt.

For illustrative purposes, and to demonstrate play, if bucket cards 40 and 42 are dealt as shown in FIG. 3 five-card community group 54 would be eligible for player selection as shown in FIG. 10 because two bucket cards are now showing in that group. The dealer indicates the availability of five-card community group 54 by placing a marker on dealer's circle area 54B. Players can indicate their selection of five-card community group 54 by moving or sliding their starting bid token to area 54A in the community card area. Players selecting a five-card community group after the second bucket card is dealt can, at their option, initiate an optional bidding round.

For illustrative purposes, and to demonstrate play, if bucket card 44 is dealt next as shown in FIG. 4, players can select five-card community group 50 or five-card community group 56 because two bucket cards are now showing in those two groups. The dealer indicates the availability of five-card community groups 50 and 56 by placing markers on circle areas 50B and 56B respectively. Players can indicate their selection of one of these groups by moving or sliding their starting bid token to community card areas 50A or 56A respectively. Players selecting a five-card community group after the third bucket card is dealt can, at their option, initiate an optional bidding round.

For illustrative purposes, and to demonstrate play, if bucket card 46 is dealt next as shown in FIG. 5, players can select five-card community group 58, five-card community group 60, or five-card community group 52 because two bucket cards are now showing in those three groups. The dealer indicates the availability of five-card community groups 52, 58 and 60 by placing markers on the dealer's circle areas 52B, 58B, and 60B respectively. Players can indicate their selection of one of the three five-card community groups 52, 58 or 60 by moving or sliding their starting bid token to the corresponding community card area 52A, 58A or 60A on the table respectively.

Players not selecting one of the six aforementioned five-card community groups containing two bucket community cards, can choose to use the four paddle cards 30, 32, 34, and 36, and the river card 38 as their five-card community group by moving or sliding their starting bid token in area 10 to the corresponding community card area 48A representing five-card community group 48, or fold. Thereafter, players' area 10 becomes the location where subsequent bids are placed by the players during the hand.

Once the last community card is dealt, the remaining cards are discarded in the discard rack 26. At this point every player, except players selecting five-card community group 48 have two of their community cards showing face-up.

After the community group selection process concludes the first round of mandatory bidding commences, starting with a bid from the player to the immediate left of the dealer (marker) 20 as shown in FIG. 14 followed by a bid from the next player seated clockwise. The players place a bid, call, raise, or fold wherein the folding players lose their starting bids. A maximum of three raises per each round of bidding can be permitted. A player can choose to "check" and pass the action to the next player in the hand if no bidding action occurred before the player's turn to bid in a bidding round.

Next, the faces of the paddle community cards 30, 32, 34, and 36 can be exposed simultaneously as shown in FIG. 6. This begins the second round of bidding starting with a bid from the player to the immediate left of the dealer (marker) 20, followed by a bid from the next player seated clockwise. The players place a bid, call, check, raise, or fold wherein the folding players lose their bids previously placed.

Finally, the face of the center river community card 38 is exposed as illustrated in FIG. 1, and the third and final round of mandatory bidding begins whereas players can bid, call, check or raise the bid in their designated bidding area 10, or fold, wherein the folding players lose all their bids previously placed. If, after the final round of bidding concludes there are at least two players remaining in the game, the players remaining in the game expose their two hole cards 28 and 29 and use between zero and two hole cards and at least three cards from their five-card community group to form their best five-card poker hand. The winning player receives the total of all the bids in the hand less the house commission.

Another version of the game in an embodiment utilizing a game board or table layout as shown in FIG. 14 includes the players placing their starting bid in their corresponding bidding area 10 and are dealt two hole cards 28 and 29 face-down, and then the five community cards 30, 32, 34, 36, and 38 are dealt face-down in the community card area in a crisscross pattern as shown in FIG. 2.

Next, the four bucket community cards 40, 42, 44, and 46 are dealt face-up randomly, consecutively, to all of the outermost points of the paddle community cards as illustrated in FIG. 5.

After the four bucket community cards 40, 42, 44 and 46 are all dealt players select a five-card community group comprising: 48, 50, 52, 54, 56, 58, or 60 as shown in FIGS. 7-13 to play their hand or fold, losing their starting bid. The players signal their selection of five-card community group by moving or sliding their starting bids in players' circle areas 10 to the corresponding community card areas 48A, 50A, 52A, 54A, 56A, 58A, or 60A on the table or board.

The first round of mandatory bidding commences, starting with a bid from the player to the immediate left of the dealer (marker) 20 followed by a bid from the next player seated clockwise. The players place a bid, call, raise, or fold wherein folding players lose their starting bids. A maximum of three raises per each round of bidding can be permitted. A player can choose to "check" and pass the action to the next player in the hand if no bidding action occurred before the player's turn to bid in a bidding round. Hereafter, all of the players' subsequent bids can be placed in players' area circles 10.

Next, the faces of the paddle community cards 30, 32, 34, and 36 are exposed simultaneously as illustrated in FIG. 6. This begins the second round of bidding starting with a bid from the player to the immediate left of the dealer (marker) 20, followed by a bid from the next player seated clockwise. The players place a bid, call, raise, check, or fold wherein folding players lose their bids previously placed.

Finally, the face of the center river community card 38 is exposed as shown in FIG. 1. The third and final round of bidding begins whereas players can fold, wherein folding players lose all their bids previously placed, or call or raise the bid in their designated encompassed areas 10. After the final round of bidding concludes, if two or more players remain in the game those players expose their two hole cards 28 and 29 and use between zero and two hole cards and at least three cards from their five-card community group to form their best five-card poker hand. The winning player receives the total of all the bids in the hand less the house commission.

In the preferred embodiment, the game is played on a table or on the Internet, player v. player, with a bidding structure that allows players to bid poker tokens, with no actual monetary value, procured online or at the casino for a commission. The commission will vary depending upon supply and demand, popularity of the game, of which value can be continuously updated in a database computer. In tournament play, poker tokens could be acquired in return for an entrance fee, with prize-winning players designated by having the most tokens at end of tournament play.

Platforms

In one embodiment, a card table, known to those skilled in the art, can be used for this community poker card game as illustrated in FIG. 14. The card table can comprise: players circled bidding areas 10; players' hole cards 28 and 29; seven five-card community group areas 48A, 50A, 52A, 54A, 56A, 58A, 60A; a dealer area which includes five-card community group availability indicator circles 48B, 50B, 52B, 54B, 56B, 58B, 60B; a chip rack 22; a dealer marker 20; a card discard area 26, and an area 24 comprising of all players' bids during a hand. Incorporated within the table can be community cards 40, 30, 38, 34, 44, 36, 46, 32, and 42 in a layout area with two hole cards 28 and 29 being dealt face-down to the players.

The game can be played on a hand-held device, video machine, or computer to challenge other players online as illustrated in FIGS. 15-16. This embodiment includes community cards 40, 42, 44, 46, 30, 32, 34, 36, and 38 placed in a layout wherein seven five-card community group areas 48A, 50A, 52A, 54A, 56A, 58A, and 60A are defined. Players designate their selection of five-card community group by signaling or touching via an interface community group areas 48A, 50A, 52A, 54A, 56A, 58A, and 60A respectively. Players' areas which surround the community card layout are used to display players' hole cards, and can include a module display as illustrated in FIG. 17 which can indicate players' identity 70, choice of five-card community group 72, type of action play 74, and bid value 76, if any, of action play 74.

Systems, Methods and Operations

In accordance with one embodiment of the present application, a method of playing a community poker card game is provided. In the embodiment, the player cards and community cards are within a single 52-card deck. The method can include multiple players, the players competing against each other. The method can include dealing two cards to at least two players and dealing five community cards face-down in a crisscross pattern. In addition, the method can include dealing an additional four community cards face-up and positioned to the outermost points of the face-down community cards. The method can include the four face-up community cards to be dealt in at least twenty four possible different combinations. The method can include at least two players selecting one of seven possible five-card community groups from within the nine community cards to play their hands with.

The method further can include receiving at least one bid from at least two players before dealing the cards. In the embodiment, the method can further include receiving at least one bid from at least two players after dealing the first two face-up community cards. The method can further include receiving at least one bid from at least two players after the third face-up community card is dealt. The method can further include receiving at least one bid from at least two players after the fourth face-up community card is dealt. The method can further include receiving at least one bid from at least two players after exposing the four face-down community cards surrounding the face-down center community card. In the embodiment, the method can further include receiving at least one bid from at least two players after exposing the face-down center community card.

The method further can include determining the best five-card poker hand from at least two players, the best five-card poker hand comprising between zero and two cards from the two cards dealt to at least two players and at least three cards from one of seven community card groups chosen by the player during the dealing of the four face-up community cards. In the embodiment, the method of the best poker hand for each of the at least two players, and determining a winner of the game, is based on the comparison of the hands.

In another embodiment the method can include receiving at least one bid from at least two players competing against each other wherein the last four community cards are dealt face-up randomly and consecutively, followed by the players selecting one of seven possible five-card community groups contained within. The method can further include receiving at least one bid from at least two players after the players select their five-card community group. The method can further include receiving at least one bid from at least two players after exposing the four face-down community cards surrounding the face-down center community card. In the embodiment, the method can further include receiving at least one bid from at least two players after exposing the face-down center community card.

The method further can include determining the best five-card poker hand from at least two players, the best five-card poker hand comprising between zero and two cards from the two cards dealt to at least two players and at least three cards from one of seven community card groups selected by the player after the dealing of the last four community cards face-up. In the embodiment, the method of the best poker hand for each of the at least two players and determining a winner of the game is based on the comparison of the hands.

The method of the best poker hand for each of at least one player and determining a winner of the game based on comparison can further include the best poker hand automatically generated by a computer program, or live dealer. Said comparison only occurs when at least two players remain in the hand.

It is to be understood, unless specifically stated otherwise, discussions utilizing terms such as "processing" or "computing" or "calculating" or "determining", refer to the action and processes of a computer system, or similar electronic computing device, commonly found in the art, that manipulates and transforms data represented as physical (electronic) quantities within the computer system circuits, memories or registers or other such information storage, transformation, transmission or display devices.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to illustrations and/or drawings of methods, apparatus (systems), and computer program products according to embodiments of the invention. It will be understood that the flow of the illustrations and/or drawings, and combinations of the flow of the illustrations and/or drawings, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flow of the illustrations. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the illustrations.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flow of the illustrations and/or drawings.

The flow of the drawings illustrates the architecture, functionality, and operation of possible implementations of systems, methods, and computer program products according to various embodiments of the present invention. In this regard, each illustration provided in the embodiment may represent a module, segment, or portion of instructions, which comprises one or more executable instructions for implementing the specified logical function(s). In some alternative implementations, the functions noted in the drawings may occur out of the order noted in the illustrations. For example, two illustrations shown in succession may, in fact, be executed substantially concurrently, or the illustrations may sometimes be executed in the reverse order, depending upon the functionality involved. It will also be noted that the flow of the drawings and/or illustrations, and combinations of the drawings and/or illustrations, can be implemented by special purpose hardware-based systems that perform the specified functions or acts or carry out combinations of special purpose hardware and computer instructions.

The random sequence of dealing the four face-up community cards in the computer embodiment can be accomplished through a generator of repetitious permutations. This requires an algorithm for pseudo-random generation of one of all available permutations, all choices equally probable, or some more probable than others.

The foregoing description of the embodiments of the invention has been presented for the purpose of illustration; it is not intended to limit the invention to the precise forms disclosed. It is intended that the scope of the invention be limited not by this detailed description, but by the claims appended hereto. Thus, the claims are not intended to be limited to the embodiments shown and described herein, but are to be given the full scope consistent with the language of the claims, wherein reference to an element in the singular is not intended to mean "one and only one" unless specifically stated, but rather "one or more."

All structural and functional equivalents to the elements of the various embodiments described throughout this disclosure that are known or later come to be known to those of ordinary skill in the relevant art are expressly incorporated herein by reference and intended to be encompassed by the claims. The foregoing description is provided to enable any person skilled in the relevant art to practice the various embodiments described herein. Various modifications to these embodiments will be readily clear to those skilled in the relevant art, and generic principles defined here can be applied to other embodiments. The features and advantages described in the summary and the detailed description are not all-inclusive. Many more features and advantages will be clear to one of ordinary skill in the art in relation with the drawings, specifications, and claims hereof.

I claim:

1. A computer program product for playing a community poker-type card game using a computer comprising at least one processor, one or more memories, one more computer readable storage media, the computer program product comprising a computer readable storage medium having program instructions embodied therewith, the program instructions executable by the computer to perform the following steps comprising:

a. dealing, by the computer, two cards to at least two players;

b. dealing, by the computer, a first five-card community group face-down in a symmetrical crisscross pattern with at least one card being a center face-down river community card, said first five-card community group further comprising four paddle cards, whereby said crisscross pattern comprising a vertical row of cards and a horizontal row of cards, said vertical and horizontal rows intersecting at the river card, and further whereby the vertical and horizontal rows each have two distal ends, the ends radially arranged with respect to the river card;

c. dealing, by the computer, first and second face-up community cards, while maintaining the crisscross pattern, said first and second face-up community cards each positioned peripherally and each said first and second face-up community card placed adjacent to one of the respective distal ends, thereby the first and second face-up community cards each adjacent to one of the paddle cards, said dealing of said first and second face-up community cards, forming a second five-card community group, said second five-card community group comprising said first and second face-up community cards and further comprising the river card and the paddle cards located between the river card and the face-up community cards;

d. informing, by the computer, the players of the second five-card community group;

e. issuing by the computer, to the players a permission or a denial of permission to select, in accordance with a set of rules governing play, either,
   1. any one of the following five-card community groups consisting of said first five-card community group and said second five-card community group, or
   2. said second five-card community group, f. dealing, by the computer, a third face-up community card, while maintaining the crisscross pattern, said third face-up community card positioned peripherally and adjacent to one of the distally positioned paddle cards, to form third and fourth five-card community groups, said third five-card community group comprising the first and third face-up community cards, the river card, and the paddle cards respectively adjacent to the first and third face-up community cards, and said fourth five-card community group comprising the second and third face-up community cards, the river card, and paddle cards adjacent to the second and third face-up community cards;

g. informing, by the computer, the players of the third and fourth five-card community groups;

h. issuing by the computer to the players, in accordance with said set of rules governing play, a permission or a denial of permission to select either,
   1. any one of the following five-card community groups consisting of said first five-card community group, said second five-card community group, said third five-card community group, and said fourth five-card community group,
   2. any one of the following five-card community groups consisting of said second five-card community group, said third five-card community group, and said fourth five-card community group, or
   3. any one of the following five-card community groups consisting of said third five-card community group, and said fourth five-card community group, i. dealing, by the computer, a fourth face-up community card positioned adjacent to the remaining distally positioned paddle card, to form fifth, sixth, and seventh five-card community groups, said fifth five-card community group comprising the first and fourth face-up community cards, the river card, and the paddle cards adjacent to the first and fourth face-up community cards, said sixth five-card community group comprising the third and fourth face-up community cards, the river card, and the paddle cards adjacent to the third and fourth face-up community cards, said seventh community group comprising said second and fourth face-up community cards, said river card, and the paddle cards adjacent to the second and fourth face-up community cards;

j. informing, by the computer, the players of the fifth, sixth, and seventh five-card community groups;

k. issuing by the computer to the players, in accordance with said set of rules governing play, a permission or a denial of permission to select either,
   1. any one of the following five-card community groups consisting of said first five-card community group, said second five-card community group, said third five-card community group, and said fourth five-card community group, said fifth five-card community group, said sixth five-card community group, and said seventh five-card community group, or
   2. any one of the following five-card community groups consisting of said second five-card community group, said third five-card community group, and said fourth five-card community group, said fifth five-card community group, said sixth five-card community group, and said seventh five-card community group, or
   3. any one of the following five-card community groups consisting of said third five-card community group, and said fourth five-card community group, said fifth five-card community group, said sixth five-card community group, and said seventh five-card community group, or
   4. any one of the following five-card community groups consisting of said fifth five-card community group, said sixth five-card community group, and said seventh five-card community group, or
   5. any one of the following five-card community groups consisting of said first five-card community group, said fifth five-card community group, said sixth five-card community group, and said seventh five-card community group;

l. simultaneously, by the computer, exposing the four paddle cards to be face-up;

m. exposing, by the computer, the river card to be face-up;

n. exposing, by the computer, a best poker hand, by the at least two players, face-up;

o. examining, by the computer, the best poker hand comprising the steps of:
   1. comparing the best poker hands of the at least two players to each other, wherein the best five-card poker hand comprises between zero and two cards from two cards dealt to the player and at least three cards from the player's community card group; and
   2. determining a winner of the game based on the comparison; and p. declaring, by the computer, the winner of the game based on the comparison.

2. The computer program product of claim 1, further comprising receiving, by the computer, at least one bid from the at least two players prior to dealing the two cards in program instruction (a).

3. The computer program product of claim 1, wherein the sequence of dealing the face up community cards in steps (c), (f), and (i) are in a random manner.

4. The computer program product of claim 1, wherein the players selecting the community group in step (c), inform other players of the selection.

5. The computer program product of claim 1, wherein the players can select either of the two community groups in step (f) to play the hand.

6. The computer program product of claim 5 wherein the players selecting the community group in step (f), inform other players of the selection.

7. The computer program product of claim 1, wherein the players can select one of the three groups of community cards in step (i), or the five face-down community cards in step (b), to play the hand, and inform the other players of the selection.

8. The computer program product of claim 1, further comprising the step of receiving, by the computer, at least one bid from the least two players after completion of program instruction (j).

9. The computer program product of claim 1, further comprising the step of receiving, by the computer, at least one bid from the at least two players after completing program instruction (l).

10. The computer program product of claim 1, further comprising the step of receiving, by the computer, at least one bid from the at least two players after completing program instruction (m).

11. The computer program product of claim 1, wherein the comparison of the best poker hand in step 1 indented under step o occurs when at least two players remain in the game.

12. A computer program product for playing a community poker-type card game, a computer comprising at least one processor, one or more memories, one more computer readable storage media, the computer program product comprising a computer readable storage medium having program instructions embodied therewith, the program instructions executable by the computer to perform the following steps comprising:

a. dealing, by the computer, two cards to at least two players;

b. dealing, by the computer, a first five-card community group face-down in a symmetrical crisscross pattern, with at least one card being a center face-down river community card, said first five-card community group further comprising four paddle cards, whereby said crisscross pattern comprising a vertical row of cards and a horizontal row of cards, said vertical and horizontal rows intersecting at the river card, and further whereby the vertical and horizontal rows each have two distal ends, the ends radially arranged with respect to the river card;

c. dealing, by the computer, first, second, third, and fourth face-up community cards each positioned adjacent to one of the four respective paddle cards, while maintaining said symmetrical crisscross pattern, said first, second, third, and fourth face-up community cards each positioned peripherally and each of the four face-up community cards placed adjacent to one of the respective distal ends and adjacent to one of any of the respective four paddle cards to form six five-card community groups, said six five-card community groups comprising, a second five-card community group, said second five-card community group comprised of said first and second face-up community cards and further comprising the river card and the paddle cards located between the river card and the first and second face-up community cards, a third five-card community group, said third five-card community group comprised of the first and third face-up community cards, the river card, and the paddle cards respectively adjacent to the first and third face-up community cards, a fourth five-card community group, said fourth five-card community group comprised of the second and third face-up community cards, the river card, and the paddle cards adjacent to the second and third face-up community cards, a fifth five-card community group, said fifth five-card community group comprised of the first and fourth face-up community cards, the river card, and the paddle cards adjacent to the first and fourth face-up community cards, a sixth five-card community card group, said sixth five-card community card group comprised of the third and fourth face-up community cards, the river card, and the paddle cards adjacent to the third and fourth face-up community cards, and a seventh five-card community card group, said seventh five-card community group comprised of said second and fourth face-up community cards, said river card, and the paddle cards adjacent to the second and fourth face-up community cards;

d. informing, by the computer, the players of the seven five-card community groups;

e. simultaneously, by the computer, exposing the four paddle cards to be face-up;

f. exposing, by the computer, the river card to be face-up;

g. exposing, by the computer, a best poker hand, by at least two of the players, face-up;

h. examining, by the computer, the best poker hand among the players further comprising the steps of:

1. comparing the best poker hand for each of the at least two players to each other, wherein the best five-card poker hand comprises between zero and two cards from the two cards dealt to the player and at least three cards from the player's chosen community card group; and 2. determining a winner of the game based on the comparison; and i. declaring, by the computer, the winner of the game based on the comparison.

13. The computer program product of claim 12, wherein the sequence of dealing the face up community cards in step (c), is in a random manner.

14. The computer program product of claim 12, further comprising program instructions of receiving, by the computer, at least one bid from the at least two players prior to dealing the two cards in step (a).

15. The computer program product of claim 12, wherein the players select one of the seven groups of community cards in step (c), and informing other players of the selection, after completion of step (d) to play the hand.

16. The computer program product of claim 12, further comprising the step of receiving, by the computer, at least one bid from the at least two players after completing step (d).

17. The computer program product of claim 12, further comprising the step of receiving, by the computer, at least one bid from the at least two players after completing step (e).

18. The computer program product of claim 12, further comprising step of receiving, by the computer, at least one bid from the at least two players after completing step (f).

19. The computer program product of claim 12, wherein the comparison of the best poker hand in step (h)(1) occurs when at least two players remain in the game.

* * * * *